US010036970B2

(12) United States Patent
Kanno et al.

(10) Patent No.: US 10,036,970 B2
(45) Date of Patent: Jul. 31, 2018

(54) MAGENTA TONER

(71) Applicant: CANON KABUSHIKI KAISHA, Tokyo (JP)

(72) Inventors: Ichiro Kanno, Kashiwa (JP); Takeshi Hashimoto, Moriya (JP); Nozomu Komatsu, Toride (JP); Masayuki Hama, Toride (JP); Hitoshi Sano, Tokyo (JP); Yuto Onozaki, Saitama (JP); Akifumi Matsubara, Narashino (JP); Takakuni Kobori, Toride (JP); Hiroyuki Fujikawa, Yokohama (JP); Tsubasa Fujisaki, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/611,865

(22) Filed: Jun. 2, 2017

(65) Prior Publication Data

US 2017/0357168 A1 Dec. 14, 2017

(30) Foreign Application Priority Data

Jun. 8, 2016 (JP) ..... 2016-114337
Feb. 22, 2017 (JP) ..... 2017-031214

(51) Int. Cl.
*G03G 9/09* (2006.01)
*G03G 9/087* (2006.01)
*G03G 9/08* (2006.01)

(52) U.S. Cl.
CPC ..... *G03G 9/091* (2013.01); *G03G 9/0808* (2013.01); *G03G 9/0819* (2013.01); *G03G 9/08711* (2013.01); *G03G 9/08755* (2013.01); *G03G 9/092* (2013.01)

(58) Field of Classification Search
CPC ..... G03G 9/08755; G03G 9/08782; G03G 9/091; G03G 9/092
See application file for complete search history.

(56) References Cited

U.S. PATENT DOCUMENTS 5,424,810 A 6/1995 Tomiyama et al.
5,464,722 A 11/1995 Tomiyama et al.
5,700,616 A 12/1997 Kasuya et al.
5,712,073 A 1/1998 Katada et al.
5,968,701 A 10/1999 Onuma et al.
5,972,553 A 10/1999 Katada et al.
6,002,895 A 12/1999 Kasuya et al.
6,007,957 A 12/1999 Kobori et al.
6,020,102 A 2/2000 Fujimoto et al.
6,120,961 A 9/2000 Tanikawa et al.
6,156,471 A 12/2000 Kobori et al.
6,203,959 B1 3/2001 Tanikawa et al.
6,235,441 B1 5/2001 Tanikawa et al.
6,430,384 B2 8/2002 Hama et al.
6,653,036 B1 11/2003 Tanikawa et al.
6,670,087 B2 12/2003 Fujikawa et al.
6,751,424 B2 6/2004 Komatsu et al.
6,808,852 B2 10/2004 Hotta et al.
7,112,395 B2 9/2006 Ida et al.
7,135,263 B2 11/2006 Kawakami et al.
7,147,980 B2 12/2006 Itakura et al.
7,147,981 B2 12/2006 Fujikawa et al.
7,279,262 B2 10/2007 Fujikawa et al.
7,288,348 B2 10/2007 Hayami et al.
7,297,455 B2 11/2007 Fujikawa et al.
7,300,733 B2 11/2007 Sugahara et al.
7,361,441 B2 4/2008 Itakura et al.
7,396,626 B2 7/2008 Fujikawa et al.
7,396,629 B2 7/2008 Baba et al.
7,442,478 B2 10/2008 Itakura et al.
7,452,647 B2 11/2008 Hayami et al.
(Continued)

FOREIGN PATENT DOCUMENTS

JP 2000-248191 * 9/2000 ..... G03G 9/09
JP 2005-107147 4/2005
(Continued)

OTHER PUBLICATIONS

Translation of JP 2015-183156 published Oct. 2015.*
Translation of JP 2000-248191 published Sep. 2000.*
Translation of JP 2014-208778 published Nov. 2014.*
U.S. Appl. No. 15/495,196, filed Apr. 24, 2017, Nozomu Komatsu.
U.S. Appl. No. 15/498,966, filed Apr. 27, 2017, Yuto Onozaki.
U.S. Appl. No. 15/600,929, filed May 22, 2017, Takeshi Hashimoto.

*Primary Examiner* — Peter L Vajda

(74) *Attorney, Agent, or Firm* — Fitzpatrick Cella Harper and Scinto

(57) ABSTRACT

Provided is a magenta toner having a toner particle containing a binder resin, a wax and a colorant, wherein the colorant contains a specific amount of a compound (1), the colorant also contains one or more compounds selected from the group consisting of a naphthol compound, a quinacridone compound and a lake compound thereof in addition to the compound (1), and the binder resin contains a specific amount of a polyester resin.

(1)

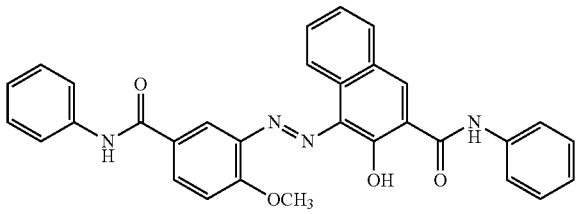

8 Claims, No Drawings

(56) References Cited

U.S. PATENT DOCUMENTS

| | | | |
|---|---|---|---|
| 7,611,813 | B2 | 11/2009 | Ida et al. |
| 7,855,042 | B2 | 12/2010 | Kobori et al. |
| 7,858,283 | B2 | 12/2010 | Ishigami et al. |
| 7,927,775 | B2 | 4/2011 | Komatsu et al. |
| 7,939,233 | B2 | 5/2011 | Inoue et al. |
| 8,137,886 | B2 | 3/2012 | Baba et al. |
| 8,142,972 | B2 | 3/2012 | Hotta et al. |
| 8,288,069 | B2 | 10/2012 | Fujikawa et al. |
| 8,921,023 | B2 | 12/2014 | Baba et al. |
| 8,927,188 | B2 | 1/2015 | Naka et al. |
| 8,986,914 | B2 | 3/2015 | Fujikawa et al. |
| 9,034,549 | B2 | 5/2015 | Shiotari et al. |
| 9,058,924 | B2 | 6/2015 | Komatsu et al. |
| 9,063,443 | B2 | 6/2015 | Ishigami et al. |
| 9,152,088 | B1 | 10/2015 | Kobori et al. |
| 9,348,253 | B2 | 5/2016 | Kanno et al. |
| 9,372,420 | B2 | 6/2016 | Mizo et al. |
| 9,417,540 | B2 | 8/2016 | Hashimoto et al. |
| 9,436,112 | B2 | 9/2016 | Iwasaki et al. |
| 9,500,975 | B2 | 11/2016 | Sugahara et al. |
| 9,594,323 | B2 | 3/2017 | Fujikawa et al. |
| 9,599,920 | B2 | 3/2017 | Sugahara et al. |
| 9,651,883 | B2 | 5/2017 | Hama et al. |
| 9,665,021 | B2 | 5/2017 | Ohtsu et al. |
| 9,665,023 | B2 | 5/2017 | Kamae et al. |
| 9,671,707 | B2 | 6/2017 | Minagawa et al. |
| 2006/0093943 | A1 | 5/2006 | Shu et al. |
| 2009/0197190 | A1 | 8/2009 | Nakamura et al. |
| 2010/0028796 | A1 | 2/2010 | Nakamura et al. |
| 2010/0183971 | A1 | 7/2010 | Fujikawa et al. |
| 2012/0107002 | A1* | 5/2012 | Nakayama ..... G03G 15/2046 399/69 |
| 2013/0244159 | A1 | 9/2013 | Ishigami et al. |
| 2013/0288173 | A1 | 10/2013 | Hashimoto et al. |
| 2014/0134535 | A1 | 5/2014 | Baba et al. |
| 2014/0137428 | A1 | 5/2014 | Takenaka et al. |
| 2014/0329176 | A1 | 11/2014 | Kanno et al. |
| 2016/0109820 | A1 | 4/2016 | Hashimoto et al. |
| 2016/0306301 | A1 | 10/2016 | Sugahara et al. |
| 2016/0363877 | A1 | 12/2016 | Hama et al. |
| 2016/0363889 | A1 | 12/2016 | Onozaki et al. |

FOREIGN PATENT DOCUMENTS

| | | | |
|---|---|---|---|
| JP | 2006-133348 | 5/2006 | |
| JP | 2013-088482 | 5/2013 | |
| JP | 2014-208778 | * 11/2014 | ..... C09B 67/48 |
| JP | 2015-183156 | * 10/2015 | ..... G03G 9/087 |

* cited by examiner

MAGENTA TONER

BACKGROUND OF THE INVENTION

Field of the Invention

The present invention relates to a magenta toner for use in electrophotographic systems, electrostatic recording systems, and electrostatic printing systems.

Description of the Related Art

With the rapid spread of electrophotographic color image-forming apparatuses in recent years, the applications of these devices have become more diverse, and the demand for image quality has been increasing more than ever before.

For example, as computer equipment for personal use has become less expensive, full-color video communication has become widespread. In image-forming apparatuses such as printers and copiers that output these images, faithful reproduction of even the finest parts is required.

At the same time, demand for color vividness has also increased, and expansion of the color reproduction range is required.

Recently, moreover, there have been remarkable advances in the printing field. Even the case of electrophotographic output images, printing speeds have increased, while the image quality standards for chroma, definition, graininess and the like are now at least as high as for printing quality.

At the same time, there is also demand for, for instance, increased printing speeds, reduced running costs and stable image quality unaffected by the environment of use, and toners that meet all of these various requirements are in demand.

In electrophotographic systems in general, an electrical latent image is formed on a photosensitive member, this latent image is then developed with a toner, and the toner image is transferred to a medium such as paper and fixed by heat and/or pressure with a fixing means to obtain an image.

In the case of a full-color image, color reproduction is performed using four toners: three chromatic toners, a yellow toner, a magenta toner and a cyan toner, in the three primary colors of color materials, together with a black toner.

The magenta toner in particular is important for combining with a yellow toner to reproduce the color red (for which humans have high visual sensitivity), and also needs to have excellent developing performance for reproducing the flesh tones of human images with complex color tones. It must also be able to reproduce the secondary color blue (commonly used in business applications) when combined with the cyan toner.

A variety of pigments for magenta toners have been proposed. Of these, the quinacridone pigment dimethyl quinacridone is commonly used because of its excellent color clarity and light resistance.

Because the tinting strength of dimethyl quinacridone is relatively low, however, there have been proposals for increasing the tinting strength of the toner by adding a large amount of dimethyl quinacridone to the toner or using it in combination with another pigment.

In conventional magenta toners, quinacridone colorants and naphthol colorants are used individually or mixed together from the standpoint of color reproducibility and tinting strength.

As an example of a magenta toner using a single colorant, a toner using a quinacridone pigment has been proposed (Japanese Patent Application No. 2013-88482). Toners using monoazo naphthol pigments have also been proposed (Japanese Patent Application No. 2005-107147, Japanese Patent Application No. 2006-133348).

SUMMARY OF THE INVENTION

However, the colorants of Japanese Patent Application No. 2013-88482, Japanese Patent Application No. 2005-107147 and Japanese Patent Application No. 2006-133348 do not fulfill all the conditions required of magenta toners. In particular, naphthol pigments for magenta toners often have poor dispersibility, and consequently they have suffered from problems of reduced transparency, color reproducibility and image density of the fixed image because the dispersed particles scatter light. Moreover, dispersion of wax and other materials within the toner is inhibited by naphthol pigments for magenta toners, so there is further room for improvement in terms of low-temperature fixability, hot offset resistance and compatibility with image-forming apparatuses.

The present invention provides a magenta toner that resolves these problems. Specifically, it provides a magenta toner with excellent hot offset resistance during fixing and excellent color reproducibility and tinting strength.

These problems can be resolved with a toner of the following configuration.

The present invention is a magenta toner having a toner particle containing a binder resin, a wax and a colorant, wherein the colorant contains a compound (1), a content of the compound (1) is at least 0.5 mass parts and not more than 20.0 mass parts per 100 mass parts of the binder resin, the colorant contains one or more compounds selected from the group consisting of a naphthol compound, a quinacridone compound and a lake compound thereof in addition to the compound (1), and the binder resin contains a polyester resin, and a content ratio of the polyester resin is at least 50 mass % and not more than 100 mass % of a total of the binder resin.

(1)

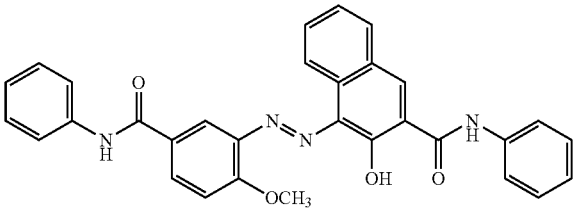

Further features of the present invention will become apparent from the following description of exemplary embodiments.

DESCRIPTION OF THE EMBODIMENTS

Unless otherwise specified, numerical ranges such as "at least A and not more than B" or "A to B" in the present invention include the minimum and maximum values at either end of the range.

The toner of the invention is a magenta toner having a toner particle containing a binder resin, a wax and a colorant, wherein the colorant contains a compound (1), a content of the compound (1) is at least 0.5 mass parts and not more than 20.0 mass parts per 100 mass parts of the binder resin, the colorant contains one or more compounds selected from the group consisting of a naphthol compound, a quinacridone compound and a lake compound thereof in addition to the compound (1), the binder resin contains a polyester resin, and a content ratio of the polyester resin is at least 50 mass % and not more than 100 mass % of a total of the binder resin.

The inventors consider that the actions and effects obtained by using the toner of the invention having such a configuration are as follows.

The toner of the invention contains the compound (1) as a colorant, and also contains one or more compounds selected from the group consisting of a naphthol compound, a quinacridone compound and a lake compound thereof in addition to the compound (1), as well as a wax and a polyester resin. It is thought that interactions between the compound (1), the polyester resin and the wax, and interactions between the compound (1) and the naphthol compound, quinacridone compound, or lake compound of these occur as a result.

The inventors believe that in the toner of the invention, the dispersibility of the pigments including the compound (1) in the toner is improved by these interactions, and that excellent hot offset resistance during fixing is obtained by increasing the wax dispersibility in the toner. The inventors believe that the reasons for this are as follows.

Organic pigment surfaces generally have low polarity. Some pigments have a polar group in the molecular structure, but the number of polar groups exposed on the particle surface is reduced because overlapping of molecules centered around polar group interactions often occurs during pigment crystallization. Consequently, it is difficult to maintain a stable dispersed state because the low-energy pigment surfaces with few polar groups have little ability to adsorb polar groups in the dispersion medium.

The compound (1) is a naphthol pigment that tends to act as a pigment derivative because it has an amino structure with the same phenyl group substituted at both ends. A pigment derivative, also called a synergist, is a compound comprising a polar group such as a sulfone group, carboxyl group or amino group directly introduced into a pigment-like framework. Because pigment derivatization is a treatment that introduces polar groups onto the pigment surface, it may have the effect of increasing the dispersibility of the pigment. Moreover, because the compound (1) has the same phenyl-substituted amino structure at both ends, it has greater affinity for the ester binding sites contained in polyester resins than the naphthol pigments that have been used in the past. It is thought that this makes the pigment less likely to re-aggregate, thereby improving the dispersibility of the pigment itself and preventing the wax from inhibiting dispersion. Moreover, a pigment derivative such as the compound (1) is extremely effective with quinacridone pigments that lack functional groups and has strong affinity for other naphthol pigments, so wax dispersibility can be further improved by combining the compound (1) with these magenta pigments, resulting in a toner with excellent hot offset resistance, color reproducibility and tinting strength.

The following are examples of naphthol compounds, quinacridone compounds and lake compounds of these that can be combined with the compound (1).

Examples of naphthol compounds include C.I. Pigment Red 31, 147, 150, 184, 238, 269 and the like.

Examples of quinacridone compounds include C.I. Pigment Red 122, 192 and 282 and C.I. Pigment Violet 19 and the like.

Examples of lake compounds of naphthol compounds and quinacridone compounds include C.I. Pigment Red 48:2, 48:3, 48:4, 57:1 and the like.

The other compound that is combined with the compound (1) is preferably a compound selected from the naphthol compounds and quinacridone compounds, and more preferably a compound selected from the naphthol pigments and quinacridone pigments. When these are used in combination with the compound (1), dispersibility within the toner particle is increased, and the color reproducibility, tinting strength and hot offset resistance during fixing of the toner are improved.

The compound represented by Formula (I) below is an example of a naphthol compound other than the compound (1).

(I)

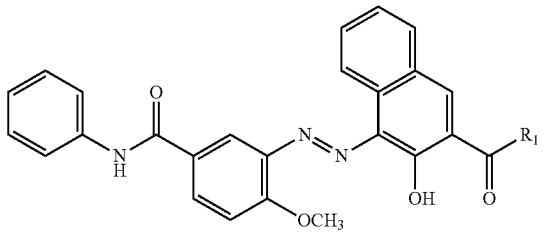

(I-2)

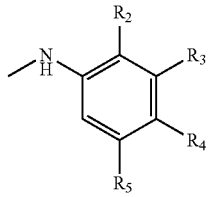

(In the formula, $R_1$ represents —$NH_2$ or a group represented by Formula (I-2). In Formula (I-2), each of $R_2$ to $R_5$ independently represents a hydrogen atom, a chlorine atom, —$NO_2$, a $C_{1-4}$ alkyl group (more preferably a methyl group) or a $C_{1-4}$ alkoxy group (more preferably a methoxy group). However, cases where $R_2$ to $R_5$ are all hydrogen atoms are excluded.)

Of the naphthol compounds, the colorant preferably contains the compound (2) below, the compound (3) below or the compounds (2) and (3) below. To further strengthen interactions with the compound (1) and increase dispersibility within the toner particle, it is desirable to use both the compound (2) and the compound (3) represented by the following formulae. The color reproducibility and tinting strength of the toner can be further increased by using the compound (1) in combination with the compounds (2) and (3).

(2)

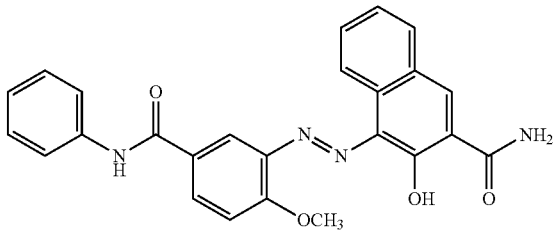

(3)

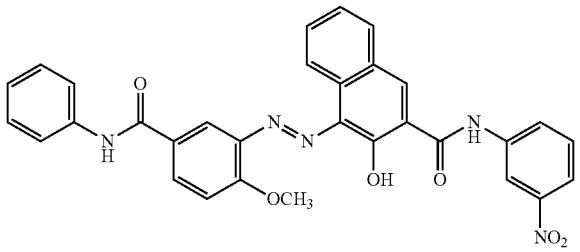

The compound (1), the compound (2) and the compound (3) may also be combined and included in a mixed state in the toner particle. The three kinds of compounds are preferably made into a solid solution and included in a mixed crystal state in the toner particle. In other words, the colorant preferably contains a pigment comprising the compound (1) and the compound (2) in a solid solution. Furthermore, the colorant preferably contains a pigment comprising the compound (1) and the compound (3) in a solid solution. In addition, the colorant preferably contains a pigment comprising the compound (1), the compound (2) and the compound (3) in a solid solution.

When the compound (1), the compound (2) and the compound (3) are used together, the compound (1) can increase the dispersion effect of the compounds (2) and (3) within the toner particle. When these are in solid solution, moreover, because the compounds suppress each other's crystal growth, they can be dispersed more finely within the toner particle. The inventors believe that as a result, the chromogenicity of each compound is realized to the fullest, greatly improving the color reproducibility and tinting strength of the toner.

In the toner of the invention, the content of the compound (1) is at least 0.5 mass parts and not more than 20.0 mass parts, or preferably at least 1.0 mass parts and not more than 3.0 mass parts per 100 mass parts of the binder resin. Good hot offset resistance during fixing, color reproducibility and tinting strength can be obtained if the added amount is within this range.

The content of the compound (2) is preferably at least 0.2 mass parts and not more than 10.0 mass parts, or more preferably at least 0.5 mass parts and not more than 2.0 mass parts per 100 mass parts of the binder resin.

The content of the compound (3) is preferably at least 0.2 mass parts and not more than 10.0 mass parts, or more preferably at least 0.5 mass parts and not more than 2.0 mass parts per 100 mass parts of the binder resin. A toner with even greater color reproducibility and tinting strength can be obtained if the added amount is within this range.

The colorant also preferably contains a quinacridone compound. An example of the quinacridone compound is the compound represented by Formula (II) below.

(II)

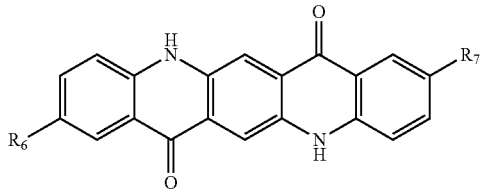

(In the formula, each of $R_6$ and $R_7$ independently represents a hydrogen atom or $C_{1-4}$ alkyl group (more preferably a methyl group).)

The added amount of the quinacridone compound is preferably at least 2.0 and not more than 12.0 mass parts per 100 mass parts of the binder resin in order to improve the color reproducibility of the toner.

Examples of lake compounds include metal salts formed with calcium, barium, strontium, manganese or the like.

Moreover, the compound (1) of the invention may be treated with a surface treatment agent or rosin compound by conventional known methods. Rosin compound treatment in particular can improve pigment dispersibility within the toner particle by preventing pigment re-aggregation, and can also bring the charging properties of the toner into a desirable state.

Examples of rosin compounds include natural rosins such as tall oil rosin, gum rosin and wood rosin, modified rosins such as hydrogenated rosin, disproportionated rosin and polymerized rosin, synthetic rosins such as styrene acrylic rosin, and alkali metal salts and ester compounds of these rosins.

In particular, abietic acid, tetrahydroabietic acid, neoabietic acid, dehydroabietic acid, dihydroabietic acid, pimaric acid, isopimaric acid, levopimaric acid and palustric acid and alkali metal salts and ester compounds of these are desirable from the standpoint of compatibility with the binder resin, and for improving the dispersibility of the pigment and the chromogenicity of the toner.

Methods of treating the colorant with a rosin compound such as those described above include (1) a dry mixing method in which the colorant is dry mixed with the rosin compound, and then subjected to a heat treatment such as melt kneading as necessary. Another method is (2) a wet treatment method in which an alkaline aqueous solution of the rosin is added to the colorant synthesis solution during colorant manufacture, and a lake metal salt such as a calcium, barium, strontium or manganese salt or the like is then added to desolubilize the rosin and coat the surface of the colorant.

The amount of the rosin compound used in treating the colorant is preferably such that the amount of the rosin compound in the colorant (colorant composition) is about 1 to 40 mass %, or more preferably 5 to 30 mass %, or still more preferably 10 to 20 mass %. The properties described above can be further improved by using this treatment amount.

The content of the compound (1) in the toner of the invention is at least 0.5 mass parts and not more than 20.0 mass parts, or preferably at least 0.1.0 mass part and not more than 3.0 mass parts per 100 mass parts of the binder resin. If the content of the compound (1) is less than 0.5 mass parts, an improvement in hot offset resistance during fixing is not anticipated. If it exceeds 20.0 mass parts, on the other hand, the toner laid-on level required to produce an output image of the desired concentration on the paper may be less, and the pigment may be in an aggregated state in the toner. Hot offset resistance may decline as a result, and a wide range of color reproducibility may be hard to achieve because the color becomes muddy.

The content of the colorant in the toner of the invention is preferably at least 3.0 mass parts and not more than 20.0 mass parts, or preferably at least 5.0 mass parts and not more than 15.0 mass parts per 100 mass parts of the binder resin. If the content of the colorant is at least 3.0 mass parts, the toner laid-on level on the paper is suitable for producing an output image of the desired concentration. If it is not more than 20.0 mass parts, the pigment is less likely to aggregate, and good hot offset resistance is obtained. The color is also less likely to become muddy, making it easier to expand the range of color reproducibility.

[Binder Resin]

The binder resin used in the toner of the invention is not particularly limited, and the following polymers or resins may be used.

For example, it is possible to use homopolymers of styrenes such as polystyrene, poly-p-chlorostyrene, polyvinyltoluene and their substitution products; styrene copolymers such as styrene-p-chlorostyrene copolymer, styrene-vinyltoluene copolymer, styrene-vinylnaphthalene copolymer, styrene-acrylic acid ester copolymer, styrene-methacrylic acid ester copolymer, styrene-α-methyl chloromethacrylate copolymer, styrene-acrylonitrile copolymer, styrene-vinyl methyl ether copolymer, styrene-vinyl ethyl ether copolymer, styrene-vinyl methyl ketone copolymer and styrene-acrylonitrile-indene copolymer; and polyvinyl chloride, phenol resin, natural modified phenol resin, natural resin-modified maleic acid resin, acrylic resin, methacrylic resin, polyvinyl acetate, silicone resin, polyester resin, polyurethane, polyamide resin, furan resin, epoxy resin, xylene resin, polyvinyl butyral, terpene resin, coumarone-indene resin, petroleum resin and the like.

In the present invention, a polyester resin is included in the binder resin for reasons of pigment dispersibility, fixing performance and developing stability. The content ratio of this polyester resin relative to the total binder resin is at least 50 mass % and not more than 100 mass %, or preferably at least 70 mass % and not more than 100 mass %.

The polyester resin used in the present invention is a resin having a "polyester unit" in the binder resin chain, and the specific components making up this polyester unit may be a dihydric or higher alcohol monomer component and an acid monomer component such as a bivalent or higher carboxylic acid, bivalent or higher carboxylic acid anhydride or bivalent or higher carboxylic acid ester or the like.

Examples of the dihydric or higher alcohol monomer component include bisphenol A alkylene oxide adducts such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)polyoxyethylene (2.0)-2,2-bis (4-hydroxyphenyl) propane and polyoxypropylene(6)-2,2-bis(4-hydroxyphenyl)propane, and ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol, polytetramethylene glycol, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerin, 2-methylpropanetriol, 2-methyl-1,2,4-butanetriol, trimethylolethane, trimethylolpropane, 1,3,5-trihydroxymethylbenzene and the like.

Of these, an aromatic diol is preferred as an alcohol monomer component, and the aromatic diol is preferably contained in the amount of at least 80 mol % and not more than 100 mol % of the alcohol monomer components constituting the polyester resin.

Examples of the acid monomer component such as a bivalent or higher carboxylic acid, bivalent or higher carboxylic acid anhydride or bivalent or higher carboxylic acid ester include aromatic dicarboxylic acids such as phthalic acid, isophthalic acid and terephthalic acid, and their anhydrides; alkyl dicarboxylic acids such as succinic acid, adipic acid, sebacic acid and azelaic acid and their anhydrides; succinic acid or succinic acid anhydride substituted with $C_{6-18}$ alkyl groups or alkenyl groups; and unsaturated dicarboxylic acids such as fumaric acid, maleic acid and citraconic acid, and their anhydrides.

Of these, polyvalent carboxylic acids such as terephthalic acid, succinic acid, adipic acid, fumaric acid, trimellitic acid, pyromellitic acid and benzophenone tetracarboxylic acid and their anhydrides are used by preference as acid monomer components.

From the standpoint of developing stability and the dispersibility of the pigment, the acid value of the polyester resin is preferably not more than 20 mg KOH/g, or more preferably not more than 15 mg KOH/g. There is no particular lower limit, but preferably it is at least 1 mg KOH/g, or more preferably at least 3 mg KOH/g.

If the acid value is not more than 20 mg KOH/g, the pigment dispersibility is good and the fixing performance and developing performance are improved.

An acid value within this range can be obtained by adjusting the types and compounded amounts of the monomers used in the resin. Specifically, it can be controlled by adjusting the component ratios of the alcohol monomer component and acid monomer component and the molecular weight of the resin during resin manufacture. It can also be controlled by reacting a terminal alcohol with a polyvalent acid monomer (such as trimellitic acid) following ester condensation polymerization.

[Resin Composition Having Structure Produced by the Reaction of a Vinyl Resin Component and a Hydrocarbon Compound]

The toner particle of the invention may also contain as necessary a resin composition having a structure produced by the reaction of a vinyl resin component and hydrocarbon compound. The pigment and wax can be finely dispersed more uniformly in the toner if this resin composition is included.

A graft polymer having a structure comprising a polyolefin grafted to a vinyl resin component and a graft polymer having a vinyl resin component comprising a vinyl monomer graft polymerized to a polyolefin are particularly desirable as this resin composition having a structure produced by the reaction of a vinyl resin component and a hydrocarbon compound.

This resin composition having a structure produced by the reaction of a vinyl resin component and a hydrocarbon compound acts as a surfactant on the melted binder resin and the wax in the kneading step and surface smoothing step during toner manufacture. Consequently, this resin composition is desirable for controlling the average primary dispersed particle diameter of the wax in the toner particle and for controlling the rate of movement of the wax to the toner surface when the toner is surface treated with hot air as necessary.

Regarding the graft polymer having a structure comprising a polyolefin grafted to a vinyl resin component or the graft polymer having a vinyl resin component comprising a vinyl monomer graft polymerized to a polyolefin, the polyolefin is not particularly limited as long as it is a polymer or copolymer of an unsaturated hydrocarbon monomer having one double bond, and a variety of polyolefins may be used. Polyethylene and polypropylene are particularly desirable.

Examples of the vinyl monomer include the following: styrene monomers, including styrenes such as styrene, o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstryene and their derivatives;

vinyl monomers containing nitrogen atoms, including alpha-methylene aliphatic monocarboxylic acid esters containing amino groups, such as dimethylaminoethyl methacrylate and diethylaminoethyl methacrylate; and acrylic and methacrylic acid derivatives such as acrylonitrile, methacrylonitrile and acrylamide;

vinyl monomers containing carboxyl groups, including unsaturated dibasic acids such as maleic acid, citraconic acid, itaconic acid, alkenylsuccinic acid, fumaric acid and mesaconic acid; unsaturated dibasic acid anhydrides such as maleic acid anhydride, citraconic acid anhydride, itaconic acid anhydride and alkenylsuccinic acid anhydride; unsaturated dibasic acid half esters such as maleic acid methyl half ester, maleic acid ethyl half ester, maleic acid butyl half ester, citraconic acid methyl half ester, citraconic acid ethyl half ester, citraconic acid butyl half ester, itaconic acid methyl half ester, alkenylsuccinic acid methyl half ester, fumaric acid methyl half ester and mesaconic acid methyl half ester; unsaturated dibasic acid esters such as dimethylmaleic acid and dimethylfumaric acid; α,β-unsaturated acids such as acrylic acid, methacrylic acid, crotonic acid and cinnamic acid; α,β-unsaturated acid anhydrides such as crotonic acid anhydride and cinnamic acid anhydride, and anhydrides of these α,β-unsaturated acids with lower fatty acids; and alkenylmalonic acid, alkenylglutaric acid, alkenyladipic acid and their anhydrides, and monoesters of these;

vinyl monomers containing hydroxyl groups, including acrylic and methacrylic acid esters such as 2-hydroxyethyl acrylate, 2-hydroxyethyl methacrylate and 2-hydroxypropyl methacrylate as well as 4-(1-hydroxy-1-methylbutyl) styrene and 4-(1-hydroxy-1-methylhexyl)styrene;

vinyl monomers containing ester units made up of acrylic acid esters, including acrylic acid esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate;

and vinyl monomers containing ester units made up of methacrylic acid esters, including alpha-methylene aliphatic monocarboxylic acid esters such as methyl methacrylate, ethyl methacrylate, propyl methacrylate, n-butyl methacrylate, isobutyl methacryalte, n-octyl methacrylate, dodecyl methacrylate, 2-ethylhexyl methacrylate, stearyl methacrylate, phenyl methacrylate, dimethylaminoethyl methacrylate and diethylaminoethyl methacryalte.

The resin composition having a structure produced by the reaction of a vinyl resin component and a hydrocarbon compound can be obtained by a known method, such as by reacting the monomers together or by reacting a monomer of one polymer with the other polymer.

The structural units of the vinyl resin component preferably include a styrene unit and also acrylonitrile or methacrylonitrile.

The mass ratio of the hydrocarbon compound and the vinyl resin component in the resin composition (hydrocarbon compound/vinyl resin component) is preferably 1/99 to 75/25. A ratio of the hydrocarbon component and vinyl resin component within this range is desirable for dispersing the pigment in the toner particle.

The content of the resin composition having a structure produced by the reaction of a vinyl resin component and a hydrocarbon compound is preferably at least 0.2 mass parts and not more than 20 mass parts, or more preferably at least 3.0 mass parts and not more than 10 mass parts per 100 mass parts of the binder resin.

The weight-average molecular weight (Mw) of the resin composition is preferably at least 6,000 and not more than 8,000, and the number-average molecular weight (Mn) is preferably at least 1,500 and not more than 5,000.

Using a resin composition within these ranges is desirable for dispersing the pigment in the toner particle.

[Wax]

The wax used in the toner of the invention is preferably a hydrocarbon wax.

The hydrocarbon wax is not particularly limited, but examples include the following: hydrocarbon waxes such as low-molecular-weight polyethylene, low-molecular-weight polypropylene, alkylene copolymers, microcrystalline wax, paraffin wax and Fischer-Tropsch wax; hydrocarbon wax oxides such as polyethylene oxide wax, and block copolymers thereof; waxes consisting primarily of fatty acid esters, such as carnauba wax; and partially or wholly deoxidized fatty acid esters, such as deoxidized carnauba wax.

Other examples include the following: saturated linear fatty acids such as palmitic acid, stearic acid and montanic acid; unsaturated fatty acids such as brassidic acid, eleostearic acid and parinaric acid; saturated alcohols such as stearyl alcohol, aralkyl alcohol, behenyl alcohol, carnaubyl alcohol, ceryl alcohol and melissyl alcohol; polyhydric alcohols such as sorbitol; esters of fatty acids such as palmitic acid, stearic acid, behenic acid and motanic acid with alcohols such as stearyl alcohol, aralkyl alcohol, behenyl alcohol, carnaubyl alcohol, ceryl alcohol and melissyl alcohol; fatty acid amides such as linoleic acid amide, oleic acid amide and lauric acid amide; saturated fatty acid bisamides such as methylenebis stearic acid amide, ethylenebis capric acid amide, ethylenebis lauric acid amide and hexamethylenebis stearic acid amide; unsaturated fatty acid amides such as ethylenebis oleic acid amide, hexamethylenebis oleic acid amide, N,N'-dioleyladipic acid amide and N,N'-dioleylsebacic acid amide; aromatic bisamides such as m-xylenebis stearic acid amide and N,N'-distearylisophthalic acid amide; aliphatic metal salts (commonly called metal soaps) such as calcium stearate, calcium laurate, zinc stearate and magnesium stearate; waxes represented by aliphatic hydrocarbon waxes grafted with styrene or acrylic acid; partial esters of fatty acids and polyhydric alcohols represented by behenic acid monoglyceride; and methyl ester compounds having hydroxyl groups obtained by hydrogenation of vegetable oils and fats.

Of these waxes, paraffin wax or Fischer-Tropsch wax is preferred for improving low-temperature fixability, hot offset resistance and resistance to winding of the transfer medium around the fixing member.

The content of the wax is preferably at least 0.5 mass parts and not more than 20.0 mass parts, or more preferably at least 3.0 mass parts and not more than 12.0 mass parts per 100 mass parts of the binder resin. To obtain a toner with both storability and high temperature offset, the peak temperature of the maximum endothermic peak in the range of at least 30° C. to not more than 200° C. in an endothermic curve measured during temperature rise with a differential scanning calorimeter (DSC) is preferably at least 50° C. and not more than 110° C., or more preferably at least 70° C. and not more than 100° C.

[Charge Control Agent]

The toner of the invention may contain a charge control agent as necessary. A known charge control agent may be used in the toner, but a metal compound of an aromatic carboxylic acid is particularly desirable because it is colorless, provides a rapid charging speed of the toner, and can stably maintain a uniform charge amount.

Examples of negative charge control agents include salicylic acid metal compounds, naphthoic acid metal compounds, dicarboxylic acid metal compounds, polymeric compounds having a sulfonic acid or carboxylic acid in the side chains, polymeric compounds having a sulfonic acid salt or sulfonic acid ester in the side chains, polymeric compounds having a carboxylic acid salt or carboxylic acid ester in the side chains, and boron compounds, urea compounds, silicon compounds and calixarenes. The charge control agent may be added either internally or externally to the toner particle. The added amount of the charge control agent is preferably at least 0.2 mass parts and not more than 10 mass parts per 100 mass parts of the binder resin.

[External Additives]

In the present invention, an external additive may also be added as necessary to improve flowability or adjust the triboelectric charge amount.

This external additive is preferably an inorganic fine particle of silica, titanium oxide, aluminum oxide, strontium titanate or the like. This inorganic fine particle is preferably one that has been hydrophobically treated with a hydrophobic agent such as a silane compound, a silicone oil or a mixture of these.

To control embedding of the external additive, the external additive is preferably an inorganic fine particle with a specific surface area of at least 10 $m^2/g$ and not more than 50 $m^2/g$.

Moreover, preferably at least 0.1 mass parts and not more than 5.0 mass parts of the external additive are used per 100 mass parts of the toner particle.

The toner particle and the external additive may be mixed with a known mixing apparatus such as a Henschel mixer, but an apparatus to be used is not particularly limited to the same as long as mixing is accomplished.

To obtain stable images over a long period of time, the toner of the invention is preferably mixed with a magnetic carrier and used in the form of a two-component developer.

Examples of the magnetic carrier includes surface-oxidized iron powder, unoxidized iron powder and other metal powders of iron, lithium, calcium, magnesium, nickel, copper, zinc, cobalt, manganese, rare earths and the like, alloy powders and oxide powders of these, magnetic bodies such as ferrite, and magnetic body-dispersed resin carriers (so-called resin carriers) containing a magnetic body and a binder resin that holds the magnetic body in a dispersed state, and other commonly known carriers.

<Manufacturing Method>

The method for manufacturing the toner of the invention is not particularly limited, and it may be manufactured by a known method. A toner manufacturing method using pulverization is given here as an example.

In the starting material mixing step, a binder, a colorant and a wax for example are weighed in predetermined amounts together with other components such as a charge control agent as necessary, and compounded and mixed as component materials of the toner particle. Examples of the mixing apparatus include a double cone mixer, V-type mixer, drum mixer, super mixer, Henschel mixer, Nauta mixer and Mechano Hybrid mixer (Nippon Coke & Engineering Co., Ltd.).

Next, the mixed materials are melt kneaded to disperse the colorant, wax and the like in the binder resin. A continuous kneading machine or a batch kneading machine such as a pressure kneader or Bunbury mixer may be used in the melt kneading step, but single-screw and twin-screw extruders are principally used because they are advantageous for continuous production. Examples include a KTK twin-screw extruder (Kobe Steel, Ltd.), TEM twin-screw extruder (Toshiba Machine Co., Ltd.), PCM kneader (Ikegai Ironworks Corp.), twin-screw extruder (KCK), co-kneader (Buss AG), Kneadex (Nippon Coke & Engineering Co., Ltd.) and the like. The resin composition obtained by melt kneading may also be rolled with twin rolls or the like, and cooled with water or the like in a cooling step.

Next, the cooled resin composition is pulverized to the desired particle diameter in a pulverization step. In the pulverization step, the composition is first coarsely pulverized with a pulverizer such as a crusher, hammer mill or feather mill for example, and then finely pulverized with a fine pulverizer such as a Kryptron system (Kawasaki Heavy Industries, Ltd.), Super Rotor (Nisshin Engineering Inc.), Turbo Mill (Turbo Kogyo Co., Ltd.) or Airjet system.

This is then classified as necessary with a classifying or screening apparatus such as an Elbow Jet using an inertial classification system (Nittetsu Mining Co., Ltd.), a Turboplex using a centrifugal classification system (Hosokawa Micron Corporation), a TSP separator (Hosokawa Micron Corporation) or a Faculty (Hosokawa Micron Corporation) to obtain a toner particle.

Next, an external additive such as an inorganic fine particle or resin particle that has been selected as necessary is added and mixed (external addition) to confer flowability, improve the charging stability and obtain a toner. Mixing is accomplished with a mixing apparatus having a rotating body equipped with a stirring member and a main casing separated by a gap from the stirring member.

Examples of this mixing apparatus include a Henschel Mixer (Mitsui Mining Co., Ltd.); a Super Mixer (Kawata Mfg Co., Ltd.); a Ribocone (Okawara Mfg. Co., Ltd.); a Nauta mixer, Turbulizer or Cyclomix (Hosokawa Micron Corporation); a spiral pin mixer (Pacific Machinery & Engineering Co., Ltd.); a Loedige mixer (Matsubo Corporation), or a Nobilta (Hosokawa Micron Corporation) or the like. A Henschel Mixer (Mitsui Mining Co., Ltd.) is preferred for mixing uniformly and breaking up silica aggregations.

The equipment conditions for mixing include throughput, stirring shaft rotation speed, stirring time, stirring blade shape, tank temperature, or the like, but these are not particularly limited and are selected appropriately considering the physical properties of the heat-treated toner particle and the types of additives and the like in order to achieve the desired toner properties.

When coarse aggregations of additives for example are freely present in the resulting toner, a screening apparatus or the like may be used as necessary.

The methods for measuring the various physical properties of the toner and starting materials in the present invention are explained next.

<Methods for Measuring Peak Molecular Weight (Mp), Number-Average Molecular Weight (Mn) and Weight-Average Molecular Weight (Mw) of Resin>

The peak molecular weight (Mp), number-average molecular weight (Mn) and weight-average molecular weight (Mw) are measured as follows by gel permeation chromatography (GPC).

A sample (resin) is first dissolved in tetrahydrofuran (THF) at room temperature over the course of 24 hours. The resulting solution is then filtered with a 0.2 μm pore diameter solvent-resistant membrane filter (Sample Pretreatment Cartridge, Tosoh Corporation) to obtain a sample solution, with the concentration of tetrahydrofuran-soluble components adjusted to about 0.8 mass %. Measurement is performed under the following conditions using this sample solution.

Apparatus: HLC8120 GPC (Detector: RI) (Tosoh Corporation)

Columns: Shodex KF-801, 802, 803, 804, 805, 806, 807 (total 7) (Showa Denko K.K.)

Eluent: Tetrahydrofuran (THF)

Flow rate: 1.0 mL/min

Oven temperature: 40.0° C.

Sample injection volume: 0.10 mL

A molecular weight calibration curve prepared using standard polystyrene resin (such as TSK standard polystyrene (product name) F-850, F-450, F-288, F-128, F-80, F-40, F-20, F-10, F-4, F-2, F-1, A-5000, A-2500, A-1000, A-500 (Tosoh Corporation)) is used for calculating the molecular weights of the samples.

<Method for Measuring Softening Point of Resin>

The softening point of the resin is measured using a constant load extrusion type capillary rheometer (Flow Tester CFT-500D flow characteristics evaluation device (Shimadzu Corporation)) according to the manual attached to the device. With this device, the temperature of a measurement sample packed in a cylinder is raised to melt the sample as a fixed load is applied with a piston from the top of the measurement sample, the melted measurement sample is extruded from a die at the bottom of the cylinder, and a flow curve is obtained showing the relationship between temperature and the amount of descent of the piston during this process.

In the present invention, the softening point is the "melting temperature by the 1/2 method" as described in the manual attached to the Flow Tester CFT-500D flow characteristics evaluation device. The melting temperature by the 1/2 method is calculated as follows. First, 1/2 the difference between the descent of the piston upon completion of outflow (Smax) and the descent of the piston at the beginning of outflow (Smin) is calculated and given as X (X=(Smax−Smin)/2). The temperature in the flow curve at which X is the descent of the piston is given as the melting point by the 1/2 method.

For the measurement sample, about 1.0 g of resin is compression molded for about 60 seconds at about 10 MPa in a 25° C. environment with a tablet molding compressor (for example NT-100H, NPa System Co., Ltd.) to obtain a cylinder about 8 mm in diameter.

The CFT-500D measurement conditions are as follows.

Test mode: Heating method

Initial temperature: 40° C.

Achieved temperature: 200° C.

Measurement interval: 1.0° C.

Ramp rate: 4.0° C./min

Piston cross-section: 1.000 $cm^2$

Test load (piston load): 10.0 kgf (0.9807 MPa)

Preheating time: 300 seconds

Die hole diameter: 1.0 mm

Die length: 1.0 mm

<Method for Measuring Acid Value of Resin>

The acid value is the number of mg of potassium hydroxide needed to neutralize the acid contained in 1 g of sample. The acid value of the binder resin is measured in accordance with JIS K 0070-1992, and the specific measurement procedures are as follows.

(1) Preparation of Reagents 1.0 g of phenolphthalein is dissolved in 90 mL of ethyl alcohol (95 vol %), and ion-exchange water is added to a total of 100 mL to obtain a phenolphthalein solution.

7 g of special-grade potassium hydroxide is dissolved in 5 mL of water, and ethyl alcohol (95 vol %) is added to a total of 1 L. Taking care to avoid contact with carbon dioxide and the like, this is placed in an alkali resistant container, left standing for 3 days, and filtered to obtain a potassium hydroxide solution. The resulting potassium hydroxide solution is stored in an alkali-resistant container. The factor of the potassium hydroxide solution is obtained by placing 25 mL of 0.1 mol/L hydrochloric acid in a triangular flask, adding several drops of the phenolphthalein solution, titrating with the potassium hydroxide solution, and determining the amount of the potassium hydroxide solution required for neutralization. The 0.1 mol/L hydrochloric acid is prepared in accordance with JIS K 8001-1998.

(2) Operations (A) Main Test 2.0 g of sample is weighed precisely into a 200 mL triangular flask, 100 mL of a toluene/ethanol (2:1) mixed solution is added, and the sample is dissolved over the course of 5 hours. Several drops of the phenolphthalein solution are then added as an indicator, and the mixture is titrated with the potassium hydroxide solution. Titration is considered to be complete when the light pink color of the indicator persists for 30 seconds.

(B) Blank Test

Titration is performed by the same operations but without a sample (using only a mixed toluene/ethanol (2:1) solution).

(3) The test results are entered into the following formula to calculate the acid value.

$$A=[(C-B)\times f\times 5.61]/S$$

In the formula, A is the acid value (mg KOH/g), B is the added amount (mL) of the potassium hydroxide solution in the blank test, C is the added amount (mL) of the potassium hydroxide solution in the main test, f is the factor of the potassium hydroxide solution, and S is the sample (g).

<Method for Measuring Hydroxyl Value of Resin>

The hydroxyl value is the number of mg of potassium hydroxide needed to neutralize the acetic acid bound to hydroxyl groups when acetylating 1 g of sample. The hydroxyl value of the resin is measured in accordance with JIS K 0070-1992, and the specific measurement procedures are as follows.

(1) Preparation of Reagents 25 mg of special-grade acetic anhydride is placed in a 100 mL measuring flask, and pyridine is added to a total of 100 mL, and thoroughly stirred to obtain an acetylation reagent. The resulting acetylation reagent is stored in a brown bottle so as to avoid contact with moisture, carbon dioxide and the like.

1.0 g of phenolphthalein is dissolved in 90 mL of ethyl alcohol (95 vol %), and ion-exchange water is added to a total of 100 mL to obtain a phenolphthalein solution.

35 g of special-grade potassium hydroxide is dissolved in 20 mL of water, and ethyl alcohol (95 vol %) is added to a total of 1 L. Taking care to avoid contact with carbon dioxide and the like, this is placed in an alkali resistant container, left standing for 3 days, and filtered to obtain a potassium hydroxide solution. The resulting potassium hydroxide solution is stored in an alkali-resistant container. The factor of the potassium hydroxide solution is obtained by placing 25 mL of 0.5 mol/L hydrochloric acid in a triangular flask, adding several drops of the phenolphthalein solution, titrating this with the potassium hydroxide solution, and determining the amount of the potassium hydroxide solution required for neutralization. The 0.5 mol/L hydrochloric acid is prepared in accordance with JIS K 8001-1998.

(2) Operations (A) Main Test 1.0 g of pulverized resin sample is weighed precisely into a 200 mL round-bottomed flask, and 5.0 mL of the acetylation reagent is then added accurately with a Hall pipette. If the sample is hard to dissolve in the acetylation reagent, a small amount of special-grade toluene is added to dissolve it.

A small funnel is placed in the mouth of the flask, and about 1 cm of the flask bottom is heated by immersing it in a roughly 97° C. glycerin bath. To prevent the temperature of the neck of the flask from rising due to the heat of the bath, the base of the neck is preferably covered with a thick paper having a round hole.

One hour later, the flask is removed from the glycerin bath and cooled. After cooling, 1 mL of water is added through the funnel, and the mixture is shaken to hydrolyze the acetic anhydride. The flask is then heated again for 10 minutes in the glycerin bath to achieve complete hydrolysis. After cooling, the walls of the funnel and flask are washed with 5 mL of ethyl alcohol.

A few drops of the phenolphthalein solution are added as an indicator, and titration is performed with the potassium hydroxide solution. Titration is considered complete when the light pink color of the indicator persisted for 30 seconds.

(B) Blank Test

Titration is performed by the same operations but without a resin sample.

(3) The test results are entered into the following formula to calculate the hydroxyl value.

$$A=[\{(B-C)\times 28.05\times f\}/S]+D$$

In the formula, A is the hydroxyl value (mg KOH/g), B is the added amount (mL) of the potassium hydroxide solution in the blank test, C is the added amount (mL) of the potassium hydroxide solution in the main test, f is the factor of the potassium hydroxide solution, S is the sample (g), and D is the acid value (mg KOH/g) of the resin.

<Measuring Maximum Endothermic Peak of Wax>

The peak temperature of the maximum endothermic peak of the wax is measured with a Q1000 differential scanning calorimeter (TA instruments) in accordance with ASTM D3418-82, The melting points of indium and zinc are used for temperature correction of the device detection part, and the heat of fusion of indium is used for correction of the calorific value.

Specifically, about 10 mg of wax is weighed precisely and placed in an aluminum pan, and using an empty aluminum pan for reference, measurement is performed at a ramp rate of 10° C./min within the measurement range of 30° C. to 200° C. During measurement, the temperature is raised once to 200° C., then lowered to 30° C., and then raised again. The temperature of the maximum endothermic peak in the DSC curve in the range of 30° C. to 200° C. during this second temperature increase is taken as the peak temperature of the maximum endothermic peak of the wax.

<Measuring Content of Compound (1) in Toner>

The content of the compound (1) in the toner can be measured using a RINT-TTRII measurement apparatus (Rigaku Corporation)—an X-ray analysis apparatus—together with the accessory control software and analysis software of the apparatus.

The measurement conditions are as follows.

X-rays: Cu/50 kV/300 mA
Goniometer: Rotor horizontal goniometer (TTR-2)
Attachment: Standard sample holder
Divergence slit: Release
Divergence vertical control slit: 10.00 mm
Scattering slit: Open
Receiving slit: Open
Counter: Scintillation counter
Scanning mode: Continuous
Scanning speed: 4.0000°/min
Sampling width: 0.0200°
Scanning axis: 2θ/θ
Scanning range: 10.0000° to 40.0000°

The toner to be measured is set on the sample plate, and measurement is initiated. With CuKα characteristic X-rays, measurement is performed in the range of Bragg angle (2θ±0.20 deg) 3 deg to 35 deg, and based on the resulting spectrum the integrated intensity of the spectrum when 2θ is 4.0 deg to 5.0 deg is compared with a calibration curve prepared by preliminarily varying the amount of the compound (1), to determine the content of the compound (1) in the toner.

<Measuring Content of Polyester Resin in Binder Resin from Toner>

Based on the respective nuclear magnetic resonance spectroscopy (1H-NMR) spectra of the polyester resin and the other binder resin components, the content of the polyester resin in the toner is calculated from the integral values of the nuclear magnetic resonance spectroscopy (1H-NMR) spectrum of the toner.

Measurement apparatus: FT NMR unit JNM-EX400 (JEOL Ltd.)

Measurement frequency: 400 MHz
Pulse condition: 5.0 μs
Frequency range: 10,500 Hz
Cumulative number: 64

<Measuring Content of Colorant in Toner>

The content of the colorant in the toner can be measured using a RINT-TTRII measurement apparatus (Rigaku Corporation)—an X-ray analysis apparatus—together with the accessory control software and analysis software of the apparatus.

The measurement conditions are as follows.

X-rays: Cu/50 kV/300 mA
Goniometer: Rotor horizontal goniometer (TTR-2)
Attachment: Standard sample holder
Divergence slit: Release
Divergence vertical control slit: 10.00 mm
Scattering slit: Open
Receiving slit: Open
Counter: Scintillation counter
Scanning mode: Continuous
Scanning speed: 4.0000°/min
Sampling width: 0.0200°

Scanning axis: 2θ/θ

Scanning range: 10.0000° to 40.0000°

The toner to be measured is set on the sample plate, and measurement is initiated. With CuKα characteristic X-rays, measurement is performed in the range of Bragg angle (2θ±0.20 deg) 3 deg to 35 deg, and the content of the colorant in the toner is obtained by subtracting the integrated intensity of the spectra derived from sources other than the colorant from the total integrated intensity of the resulting spectrum.

<Measuring Acid Value of Polyester Resin from Toner>

The following method may be used as the method of measuring the acid value of the polyester resin from the toner. The polyester resin is separated from the toner by the following method, and its acid value is measured.

The toner is dissolved in tetrahydrofuran (THF), and the solvent is distilled off under reduced pressure from the resulting soluble matter to obtain the tetrahydrofuran (THF)-soluble component of the toner.

The resulting tetrahydrofuran (THF)-soluble component of the toner is dissolved in chloroform to prepare a sample solution with a concentration of 25 mg/mL.

3.5 mL of the resulting sample solution is poured into the following device, and the part with a molecular weight of 2,000 or more is separated out as the resin component under the following conditions.

Preparative GPC apparatus: Preparative HPLC LC-980 (Japan Analytical Industry Co., Ltd.)

Preparative columns: JAIGEL 3H, JAIGEL 5H (Japan Analytical Industry Co., Ltd.)

Eluent: Chloroform

Flow rate: 3.5 mL/min

Once the molecular weight component attributable to the resin has been separated out, the solvent is distilled off under reduced pressure, and the product is further dried for 24 hours under reduced pressure in a 90° C. atmosphere. These operations are repeated until about 2.0 g of the resin component is obtained. The acid value is measured by the methods described above using the resulting sample.

EXAMPLES

Although the basic configuration and features of the invention have been described above, the invention is explained in more detail below based on examples. However, the present invention is not limited by these examples. Unless otherwise specified, parts and percentages in the examples are based on mass.

<Manufacture of Compound (1)>

50 parts of 3-hydroxy-4-methoxybenzanilide were dispersed uniformly in 1,000 parts of water, ice was added to lower the temperature to 0° C. to 5° C., 60 parts of a 35% HCl aqueous solution were slowly added dropwise with high-speed stirring, and vigorous stirring was then continued for 20 minutes. 50 parts of a 30% sodium nitrite aqueous solution were then added, and the mixture was stirred for 60 minutes, after which 2 parts of sulfamic acid were added to eliminate the nitrous acid. 50 parts of sodium acetate and 75 parts of 90% acetic acid were then added to obtain a diazonium salt solution.

Separately, 50 parts of N-phenyl-2-naphthalene carboamide were dissolved at 80° C. or less in 1,000 parts of water together with 25 parts of sodium hydroxide, and 3 parts of sodium alkylbenzenesulfonate were added to obtain a coupler solution.

This coupler solution was maintained at 10° C. or less as the previous diazonium salt solution was added all at once under vigorous stirring. After addition, gentle stirring was continued until the coupling reaction was complete, after which the mixture was heated to 120° C. and filtered to obtain the compound (1).

<Manufacturing Example of Colorant 1>

| | |
|---|---|
| Ion-exchange water | 1,500 parts |
| Compound (1) | 100.0 parts |

These materials were stirred and mixed to suspend the compound (1) in the water. 15.0 parts of tetrahydroabietic acid, 5.0 parts of abietic acid and 30 parts of a 33% sodium hydroxide aqueous solution were then added. The solution temperature was raised to 98° C., and maintained at that temperature as the mixture was stirred for 1 hour. The temperature was lowered to 65° C., after which about 60 parts of 31% hydrochloric acid were added to precipitate the resin. The precipitated composition was filtered out, washed with ion-exchange water and dried to obtain a colorant 1.

<Manufacturing Examples of Colorants 2 to 5>

Colorants 2 to 5 were manufactured as in the manufacturing example of colorant 1 except that the types of compounds were changed as shown in Table 1.

<Manufacturing Examples of Colorants 6 to 8>

30.00 parts of dried dimethyl succinylosuccinate (1,4-cyclohexanedione-2,5-di-carboxylic acid methyl ester), 7.00 parts of aniline, 22.0 parts of p-toluidine, 300.00 parts of methanol and 1.00 part of hydrochloric acid (35 mass %) were placed in a pressure reactor autoclave.

The autoclave was sealed and flushed with nitrogen gas, and the internal pressure of the autoclave was maintained at a 0.1 kg/cm$^2$ gauge pressure. The mixture was stirred as the temperature inside the autoclave was raised from 25° C. to 85° C. at a ramp rate of 4.0° C./minute, and the mixture was reacted for 5 hours at 85° C.

Once the reaction mixture had cooled to 30° C. or less, the pressure was released and returned to atmospheric pressure. Cooling was then continued, and the temperature inside the autoclave was maintained at 25° C.

40.00 parts of sodium hydroxide aqueous solution (50 mass %) and 34.60 parts of sodium m-nitrobenzene sulfonate were added to the autoclave, which was then sealed.

This mixture was stirred for 10 minutes, the temperature inside the autoclave was raised from 25° C. to 85° C. at a ramp rate of 4.0° C./minute, and the mixture was reacted for 5 hours. This was then cooled again to 30° C. or less, and filtered to remove all of the solids.

The remaining solution was heated to 40° C. with stirring, 18.00 parts of hydrochloric acid (35 mass %) were added dropwise, and the mixture was maintained at this temperature for 30 minutes.

The mixture was then filtered, and the resulting filtrate cake was washed with a water/methanol (1/1 volume ratio) mixture and cold water and then dried to obtain a product.

250.00 parts of polyphosphoric acid containing $P_2O_5$ (85.0 mass %) were then added to a stirring vessel, heated with stirring, and maintained at 90° C.

45 mass parts of the intermediate product were then added, and the mixture was heated at 130° C. for 3 hours to perform a ring closure reaction. The mixture was cooled to 110° C., and 6 parts of water were added gradually over the course of 10 minutes.

The mixture was then poured into 750 mass parts of 50° C. water, and stirred for 1.5 hours at 60° C. A solid was collected by filtration, and water washed until the wash water was neutral.

100 parts of the resulting press cake was re-slurried in 170 parts of methanol, and the slurry was heated at 90° C. for 3 hours in a pressure-resistant reactor. The mixture was cooled, and adjusted to a pH of 9.0 to 9.5 with a sodium hydroxide solution (50 mass %).

A solid was collected by filtration, and water washed. The wet press cake was dried in an 80° C. oven to obtain a colorant 6. Colorants 7 and 8 were manufactured in the same way except that the types of compounds were changed as shown in Table 1.

<Manufacturing Example of Colorant 9>

185.1 parts of p-toluidine-m-sulfonic acid and 2.23 parts of Tobias acid were dissolved together with 38 parts of caustic soda in 3,000 parts of 80° C. warm water. Ice water was then added to this solution to lower the solution temperature to 20° C., 207 parts of 35% hydrochloric acid were added to perform acid precipitation, and the solution temperature was cooled to 0° C. to 5° C. 63 parts of sodium nitrite dissolved in 150 parts of water were poured in, taking care not to raise the temperature of the solution, which was stirred for 1 hour to prepare a diazonium solution. Meanwhile, 194 parts of β-oxynaphthoic acid were dissolved together with 127 parts of caustic soda in 7,400 parts of 70° C. warm water, after which 800 parts of ice water were added to prepare a coupler solution with a solution temperature of 5° C. The diazonium solution was poured into this coupler solution and stirred for 30 minutes, after which the solution temperature was adjusted to 8° C. to 10° C. and the pH to 8 to 9, and an alkaline soap solution of rosin (resin component 64 parts) was added to treat the mixture. This was stirred and mixed for 1 hour, after which a 2-hydrate powder of 195 parts of calcium chloride dissolved in 500 parts of water was poured in to lake the mixture. Next, the solution temperature was raised to 90° C., aging was performed for 30 minutes with stirring, water was added to obtain a solution temperature of 70° C., and the mixture was filtered, water washed, dried and pulverized to obtain a colorant 9. The colorant 9 is a pigment consisting primarily of a laked soluble azo compound.

<Manufacturing Example of Colorant 10>

48 parts of 3-amino-4-methoxybenzanilide were dispersed in 1,000 parts of water, 60 parts of 35% dilute hydrochloric acid were added under temperature conditions of 5° C. or less, and the mixture was stirred for 20 minutes. 50 parts of a 30% sodium nitrite aqueous solution were added and stirred for 60 minutes, after which 2 parts of sulfamic acid were added to eliminate and decompose the excess nitrous acid. 50 parts of sodium acetate and 75 parts of 90% acetic acid were then added to prepare a diazonium salt aqueous solution.

Separately, 35 parts of the compound (1) and 19 parts of the compound shown in Table 1 (naphthol compound B) were dissolved together with 25 parts of sodium hydroxide in 1,000 parts of water under temperature conditions of 5° C. or less, after which a calcium chloride aqueous solution and the anionic surfactant alkylbenzene sulfonic acid as a particle size adjuster for the pigment composition were added in suitable amounts to obtain a coupler aqueous solution.

Next, the previous diazonium salt aqueous solution was added all at once with stirring to the coupler aqueous solution, and a coupling reaction was performed at pH 5 with the temperature maintained at 5° C. or less.

A solution of 10 parts of abietic acid dissolved in 200 parts of a 0.1 mol/L sodium hydroxide aqueous solution was added, and thoroughly stirred to complete the laking reaction, and heat aging treatment was performed at a temperature of 90° C. or more to obtain a coarse pigment composition.

The coarse pigment composition was separated by filtration, and the resulting cake of pigment composition was alkali washed by re-dispersing it in a sodium hydroxide aqueous solution. After alkali washing, the coarse pigment composition was again collected by filtration, and thoroughly water washed. This operation was repeated several times, followed by high-temperature drying and fine pulverization to obtain a colorant 10, which was a solid solution pigment consisting primarily of the naphthol compound B and the compound (1) treated with calcium abietate.

<Manufacturing Examples of Colorants 11 to 13>

The colorants 11 to 13 were obtained as in the manufacturing example of colorant 10 except that the types of compounds were changed as shown in Table 1.

<Manufacturing Example of Colorant 14>

48 parts of 3-amino-4-methoxybenzanilide were dissolved in 1,000 parts of water, and 60 parts of 35% dilute hydrochloric acid were added under temperature conditions of 5° C. or less, and stirred for 20 minutes. 50 parts of a 30% sodium nitrite aqueous solution and stirred for 60 minutes, after which 2 parts of sulfamic acid were added to eliminate and decompose the excess nitrous acid. 50 parts of sodium acetate and 75 parts of 90% acetic acid were then added to prepare a diazonium salt aqueous solution.

Separately, 50 parts of the compound (1) and 19 parts of the naphthol compound B and 25 parts of the naphthol compound D shown in Table 1 were dissolved together with 25 parts of sodium hydroxide in 1,000 parts of water under temperature conditions of 5° C. or less, and suitable amounts of a calcium chloride aqueous solution and the anionic surfactant alkylbenzenesulfonic acid as a particle size adjuster for the pigment composition were added to prepare a coupler aqueous solution.

Next, the diazonium salt aqueous solution was added all at once with stirring to the coupler aqueous solution, and a coupling reaction was performed under conditions of pH 5 with the temperature maintained at 5° C. or less.

A solution of 10 parts of abietic acid dissolved in 200 parts of a 0.1 mol/L aqueous sodium hydroxide solution was then added and thoroughly stirred to complete the laking reaction, and heat aging treatment was performed at 90° C. or more to obtain a coarse pigment composition.

The coarse pigment composition was separated by filtration, and the resulting cake of pigment composition was alkali washed by re-dispersing it in a sodium hydroxide aqueous solution. After alkali washing, the coarse pigment composition was again collected by filtration, and thoroughly water washed. This operation was repeated several times, followed by high-temperature drying and fine pulverization to obtain a colorant 14, which was a solid solution pigment consisting primarily of the naphthol compound B, the naphthol compound D and the compound (1) treated with calcium abietate.

TABLE 1

| | Colorant type | Basic structure of compound | Composition of compound | | | | | | |
|---|---|---|---|---|---|---|---|---|---|
| | | | R1 | R2 | R3 | R4 | R5 | R6 | R7 |
| Colorant 1 | | Pigment having compound (1) as principal component | | | | | | | |
| Colorant 2 | Pigment having naphthol compound A as principal component | 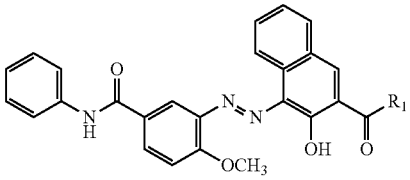 | 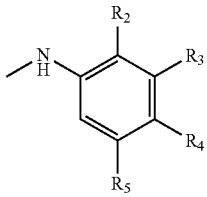 | $CH_3$ | H | H | Cl | — | |
| Colorant 3 | Pigment having naphthol compound B as principal component | | 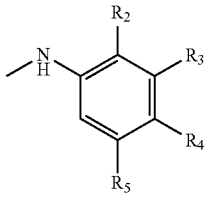 | H | H | H | $NO_2$ | — | |
| Colorant 4 | Pigment having naphthol compound C as principal component | | 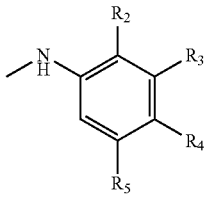 | $OCH_3$ | H | H | Cl | — | |
| Colorant 5 | Pigment having naphthol compound D as principal component | | $NH_2$ | | | | — | | |
| Colorant 6 | Pigment having quinacridone compound E as principal component | 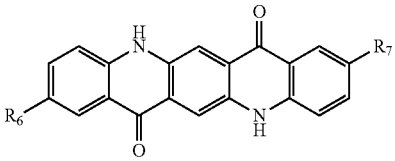 | — | | | | | $CH_3$ | $CH_3$ |
| Colorant 7 | Pigment having quinacridone compound F as principal component | | — | | | | | $CH_3$ | H |
| Colorant 8 | Pigment having quinacridone compound G as principal component | | — | | | | | H | H |
| Colorant 9 | | Pigment having naphthol lake compound as principal component | | | | | | | |
| Colorant 10 | | Solid solution pigment having compound (1) and naphthol compound B as principal components | | | | | | | |
| Colorant 11 | | Solid solution pigment having compound (1) and naphthol compound A as principal components | | | | | | | |
| Colorant 12 | | Solid solution pigment having compound (1) and naphthol compound D as principal components | | | | | | | |
| Colorant 13 | | Solid solution pigment having compound (1) and naphthol compound C as principal components | | | | | | | |
| Colorant 14 | | Solid solution pigment having compound (1), naphthol compound B and naphthol compound D as principal | | | | | | | |

<Manufacturing Example of Binder Resin 1>

76.9 parts (0.167 mol) of polyoxypropylene(2.2)-2,2-bis (4-hydroxyphenyl)propane, 25 parts (0.145 mol) of terephthalic acid, 8.0 parts (0.054 mol) of adipic acid and 0.5 parts of titanium tetrabutoxide were added to a glass 4-liter, 4-necked flask, and placed in a mantle heater with an attached thermometer, stirring rod, condenser and nitrogen introduction pipe. The inside of the flask was purged with nitrogen, the temperature was gradually raised with stirring, and a reaction was performed for 4 hours with stirring at 200° C. (first reaction step). 1.2 parts (0.006 mol) of anhydrous trimellitic acid were then added, and reacted for 1 hour at 180° C. (second reaction step) to obtain a binder resin 1.

This binder resin 1 had an acid value of 5 mg KOH/g, and a hydroxyl value of 65 mg KOH/g. According to GPC molecular weight measurement, it had a weight-average molecular weight (Mw) of 8,000, a number-average molecular weight (Mn) of 3,500, a peak molecular weight (Mp) of 5,700 and a softening point of 90° C.

<Manufacturing Example of Binder Resin 2>

71.3 parts (0.155 mol) of polyoxypropylene(2.2)-2,2-bis (4-hydroxyphenyl)propane, 24.1 parts (0.145 mol) of terephthalic acid and 0.6 parts of titanium tetrabutoxide were added to a glass 4-liter, 4-necked flask, and placed in a mantle heater with an attached thermometer, stirring rod, condenser and nitrogen introduction pipe. The inside of the flask was purged with nitrogen, the temperature was gradually raised with stirring, and a reaction was performed for 2 hours with stirring at 200° C. (first reaction step).

5.8 parts (0.030 mol %) of anhydrous trimellitic acid were then added, and reacted for 10 hours at 180° C. (second reaction step) to obtain a binder resin 2.

This binder resin 2 had an acid value of 15 mg KOH/g, and a hydroxyl value of 7 mg KOH/g. According to GPC molecular weight measurement, it had a weight-average molecular weight (Mw) of 200,000, a number-average molecular weight (Mn) of 5,000, a peak molecular weight (Mp) of 10,000 and a softening point of 130° C.

<Manufacturing Example of Binder Resin 3>

76.9 parts (0.167 mol) of polyoxypropylene(2.2)-2,2-bis (4-hydroxyphenyl)propane, 20.0 parts (0.120 mol) of terephthalic acid, 4.3 parts (0.060 mol) of acrylic acid and 0.5 parts of titanium tetrabutoxide were added to a glass 4-liter, 4-necked flask, and placed in a mantle heater with an attached thermometer, stirring rod, condenser and nitrogen introduction pipe. The inside of the flask was purged with nitrogen, the temperature was gradually raised with stirring, and a reaction was performed for 4 hours with stirring at 200° C. (first reaction step). 1.0 part (0.005 mol) of anhydrous trimellitic acid was then added, and reacted for 1 hour at 180° C. (second reaction step) to obtain a binder resin 3.

This binder resin 3 had an acid value of 0 mg KOH/g and a hydroxyl value of 82 mg KOH/g. According to GPC molecular weight measurement, it had a weight-average molecular weight (Mw) of 8,000, a number-average molecular weight (Mn) of 3,500, a peak molecular weight (Mp) of 5,700 and a softening point of 92° C.

<Manufacturing Examples of Binder Resins 4 to 6>

Binder resins 4 to 6 were obtained in the same way as the binder resin 3 except that the added amounts of the terephthalic acid and anhydrous trimellitic acid were changed as shown in Table 2 to adjust the acid values of the resulting binder resins. The acid values and hydroxyl values of the binder resins 4 to 6 are shown in Table 2.

TABLE 2

| | Monomer composition of polyester resin | | | | | Hydroxyl |
|---|---|---|---|---|---|---|
| | TPA (mass parts) | Adipic acid (mass parts) | TMA (mass parts) | Acrylic acid (mass parts) | Acid value (mgKOH/g) | value (mgKOH/g) |
| Binder resin 1 | 25.00 | 8.00 | 1.20 | — | 5.0 | 65.0 |
| Binder resin 2 | 24.10 | — | 5.80 | — | 10.0 | 12.0 |
| Binder resin 3 | 20.00 | — | 1.00 | 4.30 | 0.0 | 82.0 |
| Binder resin 4 | 24.10 | — | 3.50 | 4.30 | 15.0 | 57.0 |
| Binder resin 5 | 24.10 | — | 4.70 | 4.30 | 20.0 | 54.0 |
| Binder resin 6 | 24.10 | — | 5.30 | 4.30 | 25.0 | 56.5 |

<Manufacturing Example of Colorant Master Batch 1>

| | |
|---|---|
| Binder resin 1 | 100.00 parts |
| Colorant 10 | 30.00 parts |
| Colorant 6 | 70.00 parts |
| Distilled water | 100.00 parts |

These starting materials were first loaded into a kneader-type mixer, and mixed as the temperature was raised without pressure. Once the maximum temperature (determined absolutely by the boiling point of the solvent in the paste: about 90° C. to 100° C. in this case) was reached, transfer of the starting materials from the water phase into the molten resin phase was confirmed, and the mixture was then heated and melt kneaded for 30 minutes to thoroughly transfer the pigment in the paste. After that, the mixer was stopped and the hot water discharged, after which the temperature was further raised to 110° C. and the mixture was heated and melt kneaded for about 30 minutes to disperse the pigment and distill off the moisture, completing this step. This was then cooled, and the kneaded product was removed, and after the cooling, pulverized to a particle size of about 1 to 2 mm with a hammer mill to obtain a colorant master batch 1.

<Manufacturing Examples of Colorant Master Batches 2 to 16>

Colorant master batches 2 to 16 were obtained by changing the formulation as shown in Table 3 in the manufacturing example of the colorant master batch 1.

TABLE 3

| | Colorant type | | | | | |
|---|---|---|---|---|---|---|
| | | Added amount (mass parts) | | Added amount (mass parts) | Binder resin | Added amount (mass parts) |
| Colorant master batch 1 | Colorant 10 | 30 | Colorant 6 | 70 | Binder resin 1 | 100 |
| Colorant master batch 2 | Colorant 12 | 30 | Colorant 6 | 70 | Binder resin 1 | 100 |
| Colorant master batch 3 | Colorant 11 | 30 | Colorant 6 | 70 | Binder resin 1 | 100 |
| Colorant master batch 4 | Colorant 13 | 30 | Colorant 6 | 70 | Binder resin 1 | 100 |
| Colorant master batch 5 | Colorant 3 | 45 | Colorant 6 | 55 | Binder resin 1 | 100 |
| Colorant master batch 6 | Colorant 4 | 40 | Colorant 6 | 60 | Binder resin 1 | 100 |
| Colorant master batch 7 | Colorant 5 | 20 | Colorant 6 | 80 | Binder resin 1 | 100 |
| Colorant master batch 8 | Colorant 2 | 25 | Colorant 6 | 75 | Binder resin 1 | 100 |
| Colorant master batch 9 | Colorant 1 | 100 | — | — | Binder resin 1 | 100 |
| Colorant master batch 10 | Colorant 6 | 100 | — | — | Binder resin 1 | 100 |
| Colorant master batch 11 | Colorant 9 | 100 | — | — | Binder resin 1 | 100 |
| Colorant master batch 12 | Colorant 9 | 25 | Colorant 7 | 75 | Binder resin 1 | 100 |
| Colorant master batch 13 | Colorant 9 | 25 | Colorant 8 | 75 | Binder resin 1 | 100 |
| Colorant master batch 14 | Colorant 14 | 30 | Colorant 6 | 70 | Binder resin 1 | 100 |
| Colorant master batch 15 | Colorant 5 | 100 | — | — | Binder resin 1 | 100 |
| Colorant master batch 16 | Colorant 3 | 100 | — | — | Binder resin 1 | 100 |

<Manufacturing Example of Resin Composition 1>

| | |
|---|---|
| Low-density polyetheylene (Mw 1,400, Mn 850, maximum endothermic peak by DSC 100° C.) | 18 parts |
| Styrene | 66 parts |
| n-butyl acrylate | 13.5 parts |
| Acrylonitrile | 2.5 parts |

These materials were loaded into an autoclave, the system was purged with $N_2$, and the temperature was raised and maintained at 180° C. with stirring. 50 parts of a 2 mass % xylene solution of t-butyl hydroperoxide were added dropwise to the system continuously for 5 hours, the system was cooled, and the solvent was separated and removed to obtain a resin composition 1 produced by a reaction of the vinyl resin component with the low-density polyethylene. When the molecular weight of the resin composition 1 was measured, the weight-average molecular weight (Mw) was 7,100, and the number-average molecular weight (Mn) was 3,000. Moreover, the transmittance at a wavelength of 600 nm as measured at 25° C. with the composition dispersed in a 45 vol % methanol aqueous solution was 69%.

<Manufacturing Example of Resin Composition 2>

| | |
|---|---|
| Low-density polyetheylene (Mw 1,300, Mn 800, maximum endothermic peak by DSC 95° C.) | 20.0 parts |
| o-methylstyrene | 65.0 parts |
| n-butyl acrylate | 11.0 parts |
| Methacrylonitrile | 4.0 parts |

These materials were loaded into an autoclave, the system was purged with $N_2$, and the temperature was raised and maintained at 170° C. with stirring. 50 parts of a 2 mass % xylene solution of t-butyl hydroperoxide were added dropwise to the system continuously for 5 hours, the system was cooled, and the solvent was separated and removed to obtain a resin composition 2 produced by a reaction of the vinyl resin component with the low-density polyethylene. When the molecular weight of the resin composition 2 was measured, the weight-average molecular weight (Mw) was 6,900, and the number-average molecular weight (Mn) was 2,900. Moreover, the transmittance at a wavelength of 600 nm as measured at 25° C. with the composition dispersed in a 45 vol % methanol aqueous solution was 63%.

<Manufacturing Example of Styrene Acrylic Resin>

| | |
|---|---|
| Styrene | 70 parts |
| n-butyl acrylate | 25 parts |
| Monobutyl maleate | 5 parts |
| di-t-butyl peroxide | 1 part |

200 parts of xylene were stirred in a 4-necked flask as the vessel was thoroughly purged with nitrogen and the temperature was raised to 120° C., after which the above components were each added dropwise over the course of 3.0 hours. Polymerization was completed under further xylene reflux, and the solvent was distilled off under reduced pressure to obtain a styrene acrylic resin.

<Manufacturing Example of Toner 1>

| | |
|---|---|
| Binder resin 1 | 70.0 parts |
| Binder resin 2 | 30.0 parts |

-continued

| | |
|---|---|
| Fischer-Tropsch wax (maximum endothermic peak temperature 78° C.) | 5.0 parts |
| Colorant master batch 14 (total colorant content 50 mass %) | 15.0 parts |
| 3,5-di-t-butyl salicylic acid aluminum compound | 0.5 parts |
| Resin composition 1 | 5.0 parts |

The starting materials, shown in the formulation above were mixed at a rotational speed of 20 $s^{-1}$ for a rotation time of 5 minutes with a Henschel Mixer (FM-75, Mitsui Mining Co., Ltd.), and kneaded with a twin-screw kneader (PCM-30, Ikegai Corp) set to 125° C. The kneaded product was cooled, and coarsely pulverized to 1 mm or less in a hammer mill to obtain a coarsely pulverized product. The resulting coarsely pulverized product was finely pulverized with a mechanical pulverizer (T-250, Turbo Kogyo Co., Ltd.). This was then classified with a rotary classifier (200TSP, Hosokawa Micron Corporation) to obtain a toner particle. For the operating conditions of the rotary classifier (200TSP, Hosokawa Micron Corporation), the classifying rotor speed was 50.0 $s^{-1}$. The weight-average particle diameter (D4) of the resulting toner particle was 6.2 μm.

0.8 parts of hydrophobic silica fine particles with a number-average particle diameter of the primary particles of 10 nm that had been surface treated with 20 mass % hexamethyl disilazane and 0.2 parts of titanium oxide fine particles with a number-average particle diameter of 30 nm of the primary particles that had been surface treated with 16 mass % isobutyl trimethoxysilane were added to 100 parts of the resulting treated toner particle, and mixed at a rotational speed of 30 $s^{-1}$ for a rotation time of 10 minutes with a Henschel Mixer (FM-75, Mitsui Mining Co., Ltd.) to obtain a toner 1.

<Manufacturing Examples of Toners 2 to 33 and 35 to 38>

Toners 2 to 33 and 35 to 38 were obtained as in the manufacturing example of toner 1 except that the types of the binder resin, wax, resin composition and colorant master batch and the numbers of added parts of each were changed as shown in Table 4.

<Manufacturing Example of Toner 34>

470 parts of ion-exchange water and 3.3 parts of $Na_3PO_4$ were placed in a 2-liter, 4-necked flask equipped with a Clearmix high-speed stirring device (M Technique Co., Ltd.), the rotational speed of the high-speed stirring device was set to 10,000 rpm, and the temperature was raised to 65° C. A $CaCl_2$ aqueous solution was added to this to prepare an aqueous dispersion medium containing the fine hardly water-soluble dispersant $Ca_3(PO_4)_2$. Meanwhile, a mixture consisting of the following components was dispersed for 3 hours with an attritor (Mitsui Mining Co., Ltd.) as a dispersoid.

| | |
|---|---|
| Styrene | 66.0 parts |
| n-butyl acrylate | 34.0 parts |
| Divinyl benzene | 0.2 parts |
| Paraffin wax (maximum endothermic peak temperature 100° C.) | 5.0 parts |
| Colorant master batch 9 (total colorant content 50 mass %) | 15.0 parts |
| Colorant master batch 11 (total colorant content 50 mass %) | 15.0 parts |
| 3,5-di-t-butyl salicylic acid aluminum compound | 0.5 parts |

3 parts of 2,2'-azobis(2,4-dimethylvaleronitrile) were added at 65° C., and stirred for 1 minute to obtain a polymerizable monomer composition. Following preparation of the polymerizable monomer composition, the rotational speed of the high-speed stirring device was raised to 15,000 rpm, the polymerizable monomer composition was added to the previous aqueous dispersion medium, and this was stirred for 3 minutes in a $N_2$ atmosphere at 60° C. to granulate the polymerizable monomer composition. The stirring device was then replaced with one having a paddle stirring blade, the temperature was maintained as the mixture was stirred at 200 rpm, and the first reaction step was terminated when the polymerization rate of the polymerizable vinyl monomer reached 90%. The reaction temperature was then raised again to 80° C., and the second reaction step was terminated when the polymerization rate reached roughly 100%, completing the polymerization process. After completion of polymerization, dilute hydrochloric acid was added to the cooled mixture to dissolve the hardly water-soluble dispersant. Water washing was repeated several times in a pressure filtration device, and the product was dried to obtain a polymer particle. This polymer particle had a weight-average particle diameter of 7.2 μm.

0.8 parts of hydrophobic silica fine particles with a number-average particle diameter of the primary particles of 10 nm that had been surface treated with 20 mass % hexamethyl disilazane and 0.2 parts of titanium oxide fine particles with a number-average particle diameter of the primary particles of 30 nm that had been surface treated with 16 mass % isobutyl trimethoxysilane were added to 100 parts of the resulting polymer particle, and mixed at rotational speed of 30 $s^{-1}$ for a rotation time of 10 minutes with a Henschel Mixer (FM-75, Mitsui Mining Co., Ltd.) to obtain a toner 34.

<Preparation of Cyan Toner>

A cyan toner was obtained as in the manufacturing example of toner 1 except that the formulation of the colorant master batch and the formulations of the toner kneading, pulverization and classifying steps were changed as follows in the manufacturing example of toner 1.

(Formulation of Cyan Colorant Master Batch)

| | |
|---|---|
| Binder resin 1 | 100.00 parts |
| C.I. Pigment Blue 15:3 | 100.00 parts |
| Distilled water (Formulation of cyan toner) | 100.00 parts |
| Binder resin 1 | 70.0 parts |
| Binder resin 2 | 30.0 parts |
| Fischer-Tropsch wax (maximum endothermic peak temperature 78° C.) | 5.0 parts |
| Cyan colorant master batch | 15.0 parts |
| 3,5-di-t-butyl salicylic acid aluminum compound | 0.5 parts |

The starting materials shown in the formulation above were mixed at a rotational speed of 20 $s^{-1}$ for a rotation time of 5 minutes with a Henschel Mixer (FM-75, Mitsui Mining Co., Ltd.), and kneaded with a twin-screw kneader (PCM-30, Ikegai Corp) set to 125° C. The kneaded product was cooled, and coarsely pulverized to 1 mm or less in a hammer mill to obtain a coarsely pulverized product. The resulting coarsely pulverized product was finely pulverized with a mechanical pulverizer (T-250, Turbo Kogyo Co., Ltd.). This was then classified with a rotary classifier (200TSP, Hosokawa Micron Corporation) to obtain a toner particle. For the operating conditions of the rotary classifier (200TSP, Hosokawa Micron Corporation), the classifying rotor speed was 50.0 $s^{-1}$. The weight-average particle diameter (D4) of the resulting toner particle was 6.2 μm.

0.8 parts of hydrophobic silica fine particles with a number-average particle diameter of the primary particles of 10 nm that had been surface treated with 20 mass % hexamethyl disilazane and 0.2 parts of titanium oxide fine particles with a number-average particle diameter of the primary particles of 30 nm that had been surface treated with 16 mass % isobutyl trimethoxysilane were added to 100 parts of the resulting treated toner particle, and mixed at a rotational speed of 30 $s^{-1}$ for a rotation time of 10 minutes with a Henschel Mixer (FM-75, Mitsui Mining Co., Ltd.) to obtain a cyan toner.

TABLE 4

| Toner | Binder resin 1 | | Binder resin 2 | | Polyester resin content of binder resin | Polyester resin acid value | Wax | | | Resin composition | |
|---|---|---|---|---|---|---|---|---|---|---|---|
| No. | No. | Parts | No. | Parts | (mass %) | (mgKOH/g) | | Melting point (° C.) | Parts | No. | Parts |
| 1 | 1 | 70.0 | 2 | 30.0 | 100 | 6.5 | Fishcher-Tropsch | 78 | 5.0 | 1 | 5.0 |
| 2 | 1 | 70.0 | 2 | 30.0 | 100 | 6.5 | Fishcher-Tropsch | 78 | 5.0 | 1 | 5.0 |
| 3 | 1 | 70.0 | 2 | 30.0 | 100 | 6.5 | Fishcher-Tropsch | 78 | 5.0 | 1 | 5.0 |
| 4 | 1 | 70.0 | 2 | 30.0 | 100 | 6.5 | Fishcher-Tropsch | 78 | 5.0 | 1 | 5.0 |
| 5 | 1 | 70.0 | 2 | 30.0 | 100 | 6.5 | Fishcher-Tropsch | 78 | 5.0 | 1 | 5.0 |
| 6 | 1 | 70.0 | 2 | 30.0 | 100 | 6.5 | Fishcher-Tropsch | 90 | 5.0 | 1 | 5.0 |
| 7 | 3 | 70.0 | 2 | 30.0 | 100 | 10.0 | Paraffin wax | 100 | 5.0 | 1 | 5.0 |
| 8 | 4 | 70.0 | 2 | 30.0 | 100 | 13.5 | Paraffin wax | 100 | 5.0 | 1 | 5.0 |
| 9 | 4 | 70.0 | 2 | 30.0 | 100 | 13.5 | Paraffin wax | 100 | 5.0 | 1 | 5.0 |
| 10 | 4 | 70.0 | 2 | 30.0 | 100 | 13.5 | Ester wax | 80 | 5.0 | 1 | 5.0 |
| 11 | 4 | 70.0 | 2 | 30.0 | 100 | 13.5 | Ester wax | 80 | 5.0 | 1 | 5.0 |
| 12 | 5 | 70.0 | 2 | 30.0 | 100 | 17.0 | Ester wax | 80 | 5.0 | 1 | 5.0 |
| 13 | 5 | 70.0 | StAc | 30.0 | 72 | 20.0 | Ester wax | 80 | 5.0 | 1 | 5.0 |
| 14 | 6 | 70.0 | StAc | 30.0 | 72 | 25.0 | Ester war | 80 | 5.0 | 2 | 5.0 |
| 15 | 6 | 70.0 | StAc | 30.0 | 71 | 25.0 | Ester wax | 80 | 5.0 | 2 | 5.0 |
| 16 | 6 | 70.0 | StAc | 30.0 | 73 | 25.0 | Ester wax | 80 | 5.0 | 2 | 5.0 |
| 17 | 6 | 70.0 | StAc | 30.0 | 71 | 25.0 | Ester wax | 80 | 5.0 | 2 | 5.0 |
| 18 | 6 | 70.0 | StAc | 30.0 | 74 | 25.0 | Ester wax | 80 | 5.0 | 2 | 5.0 |
| 19 | 6 | 70.0 | StAc | 30.0 | 71 | 25.0 | Ester wax | 80 | 5.0 | 2 | 5.0 |
| 20 | 6 | 70.0 | StAc | 30.0 | 76 | 25.0 | Ester wax | 80 | 5.0 | 2 | 5.0 |
| 21 | 6 | 60.0 | StAc | 40.0 | 69 | 25.0 | Ester wax | 80 | 5.0 | 2 | 5.0 |
| 22 | 6 | 90.0 | StAc | 10.0 | 91 | 25.0 | Ester wax | 80 | 5.0 | 2 | 5.0 |
| 23 | 6 | 50.0 | StAc | 50.0 | 58 | 25.0 | Ester wax | 80 | 5.0 | 2 | 5.0 |
| 24 | 6 | 50.0 | StAc | 50.0 | 57 | 25.0 | Ester wax | 80 | 5.0 | 2 | 5.0 |
| 25 | 6 | 50.0 | StAc | 50.0 | 59 | 25.0 | Ester wax | 80 | 5.0 | 2 | 5.0 |
| 26 | 6 | 50.0 | StAc | 50.0 | 57 | 25.0 | Ester wax | 80 | 5.0 | 2 | 5.0 |
| 27 | 6 | 50.0 | StAc | 50.0 | 59 | 25.0 | Ester wax | 80 | 5.0 | 2 | 5.0 |
| 28 | 6 | 50.0 | StAc | 50.0 | 57 | 25.0 | Ester wax | 80 | 5.0 | 2 | 5.0 |
| 29 | 6 | 50.0 | StAc | 50.0 | 59 | 25.0 | Ester wax | 80 | 5.0 | 2 | 5.0 |
| 30 | 6 | 50.0 | StAc | 50.0 | 61 | 25.0 | Ester wax | 80 | 5.0 | 2 | 5.0 |
| 31 | 6 | 50.0 | StAc | 50.0 | 61 | 25.0 | Ester wax | 80 | 5.0 | 2 | 5.0 |
| 32 | 6 | 50.0 | StAc | 50.0 | 61 | 25.0 | Ester wax | 80 | 5.0 | — | |
| 33 | 5 | 40.0 | StAc | 60.0 | 48 | 20.0 | Fishcher-Tropsch | 78 | 5.0 | 2 | 5.0 |
| 34 | | StAc | | | 13 | — | Paraffin wax | 100 | 5.0 | 2 | 5.0 |
| 35 | 5 | 50.0 | StAc | 50.0 | 57 | 20.0 | Fishcher-Tropsch | 78 | 5.0 | 2 | 5.0 |
| 36 | 5 | 50.0 | StAc | 50.0 | 58 | 20.0 | Fishcher-Tropsch | 78 | 5.0 | 2 | 5.0 |
| 37 | 5 | 50.0 | StAc | 50.0 | 60 | 20.0 | Fishcher-Tropsch | 78 | 5.0 | 2 | 5.0 |
| 38 | 5 | 50.0 | StAc | 50.0 | 57 | 20.0 | Fishcher-Tropsch | 78 | 5.0 | 2 | 5.0 |

| Toner | MB (1) | | MB (2) | | Compound (1) content | Compound (2) content | Compound (3) content | Quinacridone compound content | Colorant content |
|---|---|---|---|---|---|---|---|---|---|
| No. | No. | Parts | No. | Parts | (parts) | (parts) | (parts) | (parts) | (parts) |
| 1 | 14 | 15.0 | — | — | 1.1 | 0.6 | 0.4 | 4.9 | 7.0 |
| 2 | 2 | 13.0 | 16 | 2.0 | 1.2 | 1.6 | — | 4.2 | 7.0 |
| 3 | 1 | 13.0 | 15 | 2.0 | 1.2 | — | 1.6 | 4.2 | 7.0 |
| 4 | 1 | 15.0 | — | — | 1.4 | — | 0.7 | 4.9 | 7.0 |
| 5 | 2 | 15.0 | — | — | 1.4 | 0.7 | — | 4.9 | 7.0 |
| 6 | 3 | 15.0 | — | — | 1.4 | — | — | 4.9 | 7.0 |
| 7 | 1 | 15.0 | — | — | 1.4 | — | 0.7 | 4.9 | 7.0 |
| 8 | 1 | 15.0 | — | — | 1.4 | — | 0.7 | 4.9 | 7.0 |
| 9 | 2 | 15.0 | — | — | 1.4 | 0.7 | — | 4.9 | 7.0 |
| 10 | 9 | 5.0 | 5 | 10.0 | 2.3 | — | 2.1 | 2.6 | 7.0 |
| 11 | 9 | 5.0 | 7 | 10.0 | 2.3 | 1.0 | — | 4.0 | 7.3 |
| 12 | 9 | 5.0 | 5 | 10.0 | 2.3 | — | 2.2 | 2.8 | 7.3 |
| 13 | 9 | 5.0 | 5 | 10.0 | 2.3 | — | 2.2 | 2.8 | 7.3 |
| 14 | 9 | 5.0 | 5 | 10.0 | 2.3 | — | 2.2 | 2.8 | 7.3 |
| 15 | 9 | 5.0 | 5 | 3.0 | 2.4 | — | 0.7 | 0.8 | 3.9 |
| 16 | 9 | 5.0 | 5 | 20.0 | 2.2 | — | 4.5 | 5.5 | 12.2 |
| 17 | 9 | 5.0 | 5 | 1.5 | 2.4 | — | 0.4 | 0.4 | 3.2 |
| 18 | 9 | 5.0 | 5 | 30.0 | 2.1 | — | 6.7 | 8.3 | 17.1 |
| 19 | 9 | 5.0 | 5 | 0.5 | 2.4 | — | 0.1 | 0.2 | 2.7 |
| 20 | 9 | 5.0 | 5 | 30.0 | 2.1 | — | 6.7 | 8.3 | 17.1 |

TABLE 4-continued

| | | | | | | | | | |
|---|---|---|---|---|---|---|---|---|---|
| 21 | 9 | 15.0 | 6 | 30.0 | 6.1 | — | — | 9.0 | 21.1 |
| 22 | 4 | 15.0 | — | — | 1.4 | — | — | 4.9 | 7.0 |
| 23 | 9 | 15.0 | 6 | 25.0 | 6.3 | — | — | 6.3 | 16.8 |
| 24 | 9 | 2.0 | 6 | 30.0 | 0.9 | — | — | 7.8 | 13.9 |
| 25 | 9 | 35.0 | 6 | 10.0 | 14.3 | — | — | 2.4 | 18.3 |
| 26 | 9 | 1.5 | 6 | 30.0 | 0.6 | — | — | 7.5 | 13.1 |
| 27 | 9 | 40.0 | 10 | 5.0 | 16.3 | — | — | 2.0 | 18.3 |
| 28 | 9 | 5.0 | 5 | 30.0 | 2.1 | — | 5.7 | 7.0 | 14.8 |
| 29 | 9 | 40.0 | 8 | 5.0 | 16.3 | — | — | 1.5 | 18.3 |
| 30 | 9 | 40.0 | 12 | 15.0 | 15.7 | 1.5 | — | 4.4 | 21.6 |
| 31 | 9 | 40.0 | 13 | 15.0 | 15.7 | — | — | 4.4 | 21.6 |
| 32 | 9 | 40.0 | 13 | 15.0 | 15.7 | — | — | 4.4 | 21.6 |
| 33 | 9 | 15.0 | 11 | 15.0 | 6.5 | — | — | — | 14.0 |
| 34 | 9 | 15.0 | 11 | 15.0 | 6.5 | — | — | — | 14.0 |
| 35 | 9 | 35.0 | — | — | 14.9 | — | — | — | 14.9 |
| 36 | 9 | 0.5 | 11 | 35.0 | 0.2 | — | — | — | 17.7 |
| 37 | 9 | 55.0 | 11 | 2.0 | 22.3 | — | — | — | 23.3 |
| 38 | 6 | 35.0 | — | — | — | — | — | 10.5 | 17.5 |

In the table, StAc represents styrene acrylic resin, and MB represents the colorant master batch.

<Manufacturing Example of Magnetic Carrier>

Water was added to 100 parts of $Fe_2O_3$, which was then pulverized for 15 minutes in a ball mill to prepare a magnetic core with an average particle diameter of 55 μm.

A mixed solution of 1 part of straight silicone resin (Shin-Etsu Chemical Co., Ltd.: KR271), 0.5 parts of gamma-aminopropyl triethoxysilane and 98.5 parts of toluene was added to 100 parts of the magnetic core, and the mixture was dried under reduced pressure for 5 hours at 70° C. while being mixed and kneaded in a solution decompression kneader to remove the solvent. This was then baked for 2 hours at 140° C., and sieved with a sieve shaker (300MM-2, Tsutsui Scientific Instruments Co., Ltd., 75 μm aperture) to obtain a magnetic carrier 1.

Examples 1 to 32, Comparative Examples 1 to 6

The toner 1 and magnetic carrier 1 were mixed for 5 minutes at 0.5 $s^{-1}$ with a V-type mixer (V-10 mixer, Tokuju Seisakusho) so that the toner concentration was 9 mass %, to obtain a two-component developer 1. Two-component developers 2 to 38 and two-component developer C were obtained by changing the combination of toner and magnetic carrier as shown in Table 5. The two-component developers of Examples 1 to 32 and Comparative Examples 1 to 6 were then evaluated as follows. The evaluation results are shown in Table 6.

TABLE 5

| | Toner No. | Carrier No. | Two-component developer No. |
|---|---|---|---|
| Magenta developer | | | |
| Example 1 | Toner 1 | Carrier 1 | Two-component developer 1 |
| Example 2 | Toner 2 | Carrier 1 | Two-component developer 2 |
| Example 3 | Toner 3 | Carrier 1 | Two-component developer 3 |
| Example 4 | Toner 4 | Carrier 1 | Two-component developer 4 |
| Example 5 | Toner 5 | Carrier 1 | Two-component developer 5 |
| Example 6 | Toner 6 | Carrier 1 | Two-component developer 6 |
| Example 7 | Toner 7 | Carrier 1 | Two-component developer 7 |
| Example 8 | Toner 8 | Carrier 1 | Two-component developer 8 |
| Example 9 | Toner 9 | Carrier 1 | Two-component developer 9 |
| Example 10 | Toner 10 | Carrier 1 | Two-component developer 10 |
| Example 11 | Toner 11 | Carrier 1 | Two-component developer 11 |
| Example 12 | Toner 12 | Carrier 1 | Two-component developer 12 |
| Example 13 | Toner 13 | Carrier 1 | Two-component developer 13 |
| Example 14 | Toner 14 | Carrier 1 | Two-component developer 14 |
| Example 15 | Toner 15 | Carrier 1 | Two-component developer 15 |

TABLE 5-continued

| | Toner No. | Carrier No. | Two-component developer No. |
|---|---|---|---|
| Example 16 | Toner 16 | Carrier 1 | Two-component developer 16 |
| Example 17 | Toner 17 | Carrier 1 | Two-component developer 17 |
| Example 18 | Toner 18 | Carrier 1 | Two-component developer 18 |
| Example 19 | Toner 19 | Carrier 1 | Two-component developer 19 |
| Example 20 | Toner 20 | Carrier 1 | Two-component developer 20 |
| Example 21 | Toner 21 | Carrier 1 | Two-component developer 21 |
| Example 22 | Toner 22 | Carrier 1 | Two-component developer 22 |
| Example 23 | Toner 23 | Carrier 1 | Two-component developer 23 |
| Example 24 | Toner 24 | Carrier 1 | Two-component developer 24 |
| Example 25 | Toner 25 | Carrier 1 | Two-component developer 25 |
| Example 26 | Toner 26 | Carrier 1 | Two-component developer 26 |
| Example 27 | Toner 27 | Carrier 1 | Two-component developer 27 |
| Example 28 | Toner 28 | Carrier 1 | Two-component developer 28 |
| Example 29 | Toner 29 | Carrier 1 | Two-component developer 29 |
| Example 30 | Toner 30 | Carrier 1 | Two-component developer 30 |
| Example 31 | Toner 31 | Carrier 1 | Two-component developer 31 |
| Example 32 | Toner 32 | Carrier 1 | Two-component developer 32 |
| Comparative Example 1 | Toner 33 | Carrier 1 | Two-component developer 33 |
| Comparative Example 2 | Toner 34 | Carrier 1 | Two-component developer 34 |
| Comparative Example 3 | Toner 35 | Carrier 1 | Two-component developer 35 |
| Comparative Example 4 | Toner 36 | Carrier 1 | Two-component developer 36 |
| Comparative Example 5 | Toner 37 | Carrier 1 | Two-component developer 37 |
| Comparative Example 6 | Toner 38 | Carrier 1 | Two-component developer 38 |
| Cyan developer | | | |
| Cyan toner | | Carrier 1 | Two-component developer C |

<Method for Evaluating Tinting Strength of Toner>

Using a modified imageRUNNER ADVANCE C5255 full-color copier (Canon Inc.) as the image-forming apparatus, the two-component developer 1 was loaded into the magenta station developing device, and evaluated.

The evaluation environment was a normal-temperature, normal-humidity environment (23° C., 50% RH), and the evaluation paper was GFC-081 plain copy paper (A4, basis weight 81.4 g/$m^2$, sold by Canon Marketing Japan Inc.).

The toner laid-on level on the paper was varied in this evaluation environment, and the relationship between image density and the toner laid-on level on the paper was investigated.

Next, the image density of an FFH image (solid image) was adjusted to 1.40, and the toner laid-on level when the image density was 1.40 was determined.

An FFH is a value obtained by displaying 256 gradations in hexadecimal notation, with OOH being the first gradation (white part), and FFH the 256th gradation (solid part).

The image density was measured using an X-Rite color reflection densitometer (500 series, X-Rite, Incorporated).

The tinting strength of the toner was evaluated according to the following standard based on the toner laid-on level ($mg/cm^2$). The evaluation results are shown in Table 6.

(Evaluation Standard)

AA: Less than 0.30

A: At least 0.30, less than 0.35

B: At least 0.35, less than 0.50

C: At least 0.50, less than 0.65

D: At least 0.65

(Evaluating Color Reproducibility of Toner)

Using a modified imageRUNNER ADVANCE C5255 full-color copier (Canon Inc.) as the image-forming apparatus, the two-component developer 1 was loaded into the magenta station developing device, the two-component developer C was loaded into the cyan station developing device, and an evaluation was performed. The evaluation environment was a normal-temperature, normal-humidity environment (23° C., 50% RH), and the evaluation paper was GFC-081 plain copy paper (A4, basis weight 81.4 $g/m^2$, sold by Canon Marketing Japan Inc.).

An image in the secondary color blue was formed using the two-component developer 1 and the two-component developer C. A compartmentalized image was formed with 16 gradations ranging from OOH (solid white) to FFH (solid color). In forming the secondary color image, the laid-on level of the FFH (solid color) image using the two-component developer 1 was given as the laid-on level at which the image density was 1.40 using a single color. For the two-component developer C, the laid-on level of the FFH (solid) image was adjusted to 0.40 $mg/cm^2$. A laid-on level of 0.40 $mg/cm^2$ is the level at which the single-color image density is 1.40 using the two-component developer C. In the resulting 16-gradation secondary color (blue) image, the L*, a* and b* of each of the gradations were measured with a SpectroScan Transmission (GretagMacbeth GmbH) (measurement condition: $D_{50}$ view angle 2°), and the C* of each gradation was determined by the following formula:

$$C^*=\{(a^*)^2+(b^*)^2\}^{0.5}$$

the C* values of each gradation were compared, and C*(C*max) was determined and used to evaluate blue color reproducibility. The greater the value of C*max, the better the blue color reproducibility, which was evaluated according to the following standard. The evaluation results are shown in Table 6.

(Evaluation Standard)

AA: At least 60

A: At least 55, less than 60

B: At least 50, less than 55

C: At least 42, less than 50

D: Less than 42

(Method for Evaluating Fogging of Non-Image Part (White Part))

Using a modified imageRUNNER ADVANCE C5255 full-color copier (Canon Inc.) as the image-forming apparatus, the two-component developer 1 was loaded into the magenta station developing device, and an evaluation was performed.

The evaluation environment was a normal-temperature, normal-humidity environment (23° C., 50% RH), and the evaluation paper was GFC-081 plain copy paper (A4, basis weight 81.4 $g/m^2$, sold by Canon Marketing Japan Inc.).

Fogging of the white part was evaluated before and after endurance in each environment. The average reflectance Dr (%) of the evaluation paper before image output was measured with a reflectometer (Reflectometer Model TC-6DS from Tokyo Denshoku Co., Ltd.).

The reflectance Ds (%) of the OOH image part (white part) was measured initially (first sheet) and after endurance (50,000th sheet). Fogging (%) was then calculated by the following formula from the resulting Dr and Ds values (initially and after endurance). Fogging was then evaluated based on the standard below.

$$\text{Fogging }(\%)=Dr(\%)-Ds(\%)$$

The evaluation results are shown in Table 6.

(Evaluation Standard)

A: Less than 0.5%

B: At least 0.5%, less than 1.0%

C: At least 1.0%, less than 2.0%

D: At least 2.0%

(Method for Evaluating Hot Offset Resistance)

Using a modified image PRESS C800 full-color copier (Canon Inc.) as the unfixed image-forming apparatus, the two-component developer 1 was loaded into the magenta station developing device, and an evaluation was performed. The evaluation paper was GFC-081 plain copy paper (A4, basis weight 81.4 $g/m^2$, sold by Canon Marketing Japan Inc.). An unfixed toner image 2.0 cm high by 15.0 cm wide (toner laid-on level 0.08 $mg/cm^2$) was formed on the paper 2.0 cm from the top edge in the direction of feed in a normal-temperature, normal-humidity environment (23° C., 60% RH).

The fixing test was performed using a fixing unit that had been removed from an imageRUNNER ADVANCE C5255 full-color copier (Canon Inc.) and modified so that the fixing temperature could be adjusted. In a normal-temperature, low-humidity environment (23° C., 10% RH), with the process speed set to 265 mm/s, the temperature was raised from 150° C. to 210° C. in 1° C. increments, and fixed images were obtained from the previous unfixed image at each temperature. The hot offset resistance of the resulting fixed images was then evaluated.

Hot offset was evaluated visually with the fixed images, and hot offset resistance was evaluated. The results are shown in Table 6.

(Evaluation Standard)

A: No hot offset occurs at 210° C.

B: Hot offset occurs at temperatures of at least 190° C. and less than 210° C.

C: Hot offset occurs at temperatures of at least 170° C. and less than 190° C.

D: Hot offset occurs below 170° C.

TABLE 6

| | Colorant | | | | Fogging of non-image part | | | | Hot offset resistance | |
|---|---|---|---|---|---|---|---|---|---|---|
| | Toner laid-on level ($mg/cm^2$) at which image density is 1.40 | Rank | Color reproducibility C*max | Rank | Initial (%) | Rank | After endurance (%) | Rank | Temperature at which hot offset occurs (° C.) | Rank |
| Example 1 | 0.28 | AA | 62 | AA | 0.1 | A | 0.2 | A | None | A |
| Example 2 | 0.29 | AA | 59 | A | 0.1 | A | 0.2 | A | None | A |
| Example 3 | 0.31 | A | 60 | AA | 0.2 | A | 0.2 | A | None | A |
| Example 4 | 0.32 | A | 59 | A | 0.1 | A | 0.2 | A | None | A |
| Example 5 | 0.33 | A | 58 | A | 0.1 | A | 0.2 | A | None | A |
| Example 6 | 0.32 | A | 58 | A | 0.2 | A | 0.2 | A | None | A |
| Example 7 | 0.33 | A | 55 | A | 0.2 | A | 0.2 | A | None | A |
| Example 8 | 0.32 | A | 56 | A | 0.2 | A | 0.2 | A | None | A |
| Example 9 | 0.33 | A | 55 | A | 0.2 | A | 0.3 | A | None | A |
| Example 10 | 0.34 | A | 56 | A | 0.3 | A | 0.4 | A | 209 | B |
| Example 11 | 0.34 | A | 55 | A | 0.5 | B | 0.5 | B | 208 | B |
| Example 12 | 0.34 | A | 56 | A | 0.3 | A | 0.4 | A | 209 | B |
| Example 13 | 0.34 | A | 55 | A | 0.3 | A | 0.4 | A | 207 | B |
| Example 14 | 0.36 | B | 56 | A | 0.3 | A | 0.4 | A | 208 | B |
| Example 15 | 0.35 | B | 55 | A | 0.3 | A | 0.4 | A | 209 | B |
| Example 16 | 0.38 | B | 57 | A | 0.3 | A | 0.6 | B | 209 | B |
| Example 17 | 0.40 | B | 55 | A | 0.3 | A | 0.7 | B | 208 | B |
| Example 18 | 0.40 | B | 57 | A | 0.3 | A | 0.7 | B | 208 | B |
| Example 19 | 0.43 | B | 56 | A | 0.3 | A | 0.7 | B | 204 | B |
| Example 20 | 0.45 | B | 55 | A | 0.3 | A | 0.7 | B | 203 | B |
| Example 21 | 0.42 | B | 55 | A | 0.3 | A | 0.8 | B | 203 | B |
| Example 22 | 0.42 | B | 54 | B | 0.4 | A | 0.8 | B | 204 | B |
| Example 23 | 0.41 | B | 54 | B | 0.3 | A | 0.8 | B | 205 | B |
| Example 24 | 0.43 | B | 52 | B | 0.3 | A | 0.8 | B | 205 | B |
| Example 25 | 0.46 | B | 54 | B | 0.4 | A | 0.8 | B | 200 | B |
| Example 26 | 0.44 | B | 53 | B | 0.3 | A | 0.8 | B | 205 | B |
| Example 27 | 0.49 | B | 54 | B | 0.4 | A | 0.7 | B | 201 | B |
| Example 28 | 0.41 | B | 53 | B | 0.4 | A | 0.9 | B | 198 | B |
| Example 29 | 0.48 | B | 50 | B | 0.5 | B | 0.8 | B | 195 | B |
| Example 30 | 0.49 | B | 51 | B | 0.7 | B | 0.9 | B | 192 | B |
| Example 31 | 0.48 | B | 50 | B | 0.7 | B | 0.9 | B | 193 | B |
| Example 32 | 0.49 | B | 50 | B | 0.8 | B | 0.9 | B | 190 | B |
| Comparative Example 1 | 0.49 | B | 47 | C | 1.0 | C | 1.5 | C | 186 | C |
| Comparative Example 2 | 0.49 | B | 49 | C | 1.1 | C | 1.4 | C | 175 | C |
| Comparative Example 3 | 0.59 | C | 43 | C | 0.8 | B | 1.3 | C | 180 | C |
| Comparative Example 4 | 0.53 | C | 48 | C | 1.4 | C | 1.6 | C | 179 | C |
| Comparative Example 5 | 0.51 | C | 49 | C | 1.7 | C | 1.8 | C | 176 | C |
| Comparative Example 6 | 0.54 | C | 50 | B | 0.8 | B | 1.9 | C | 171 | C |

The present invention provides a magenta toner with excellent color reproducibility, tinting strength and hot offset resistance during fixing.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-114337, filed Jun. 8, 2016 and Japanese Patent Application No. 2017-031214, filed Feb. 22, 2017, which are hereby incorporated by reference herein in their entirety.

What is claimed is:

1. A magenta toner having a toner particle containing a binder resin, a wax and a colorant, wherein the colorant contains a compound (1) and a compound (3), a content of the compound (1) is 0.5 to 20.0 mass parts per 100 mass parts of the binder resin, a content of the compound (3) is 0.2 to 10.0 mass parts per 100 mass parts of the binder resin, and the binder resin contains a polyester resin, a content ratio of the polyester resin is 50 to 100 mass % of a total of the binder resin:

(1)

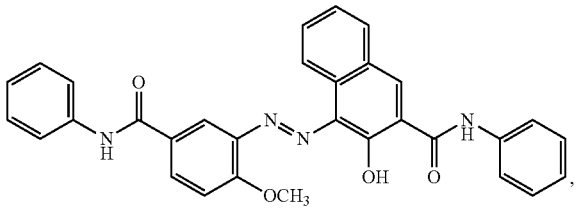

and (3)

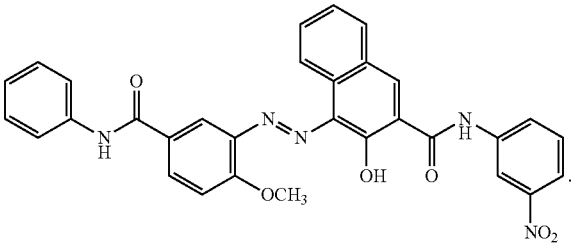

2. The magenta toner according to claim 1, wherein the content of the colorant is 3.0 to 20.0 mass parts per 100 mass parts of the binder resin.

3. The magenta toner according to claim 1, wherein an acid value of the polyester resin is not more than 20 mg KOH/g.

4. The magenta toner according to claim 1, wherein the wax is a hydrocarbon wax.

5. The magenta toner according to claim 1, wherein the colorant contains a quinacridone compound.

6. The magenta toner according to claim 1, wherein the colorant contains the compound (2), a content of the compound (2) being 0.2 to 10.0 mass parts per 100 mass parts of the binder resin:

(2)

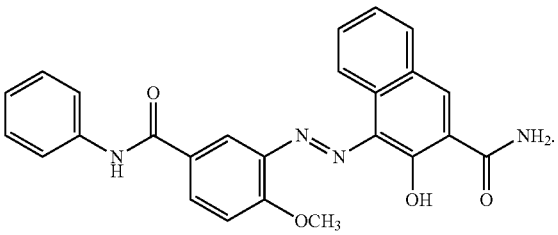

7. A magenta toner having a toner particle containing a binder resin, a wax and a colorant, wherein the colorant contains a pigment comprising a compound (1) and a compound (3) in solid solution a content of the compound (1) is 0.5 to 20.0 mass parts per 100 mass parts of the binder resin, and the binder resin contains a polyester resin, a content ratio of the polyester resin is 50 to 100 mass % of a total of the binder resin:

(1)

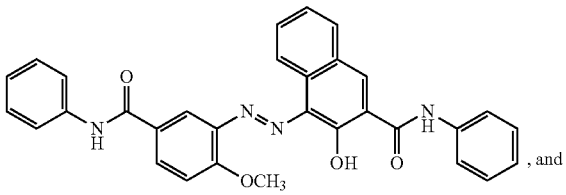

-continued (3)

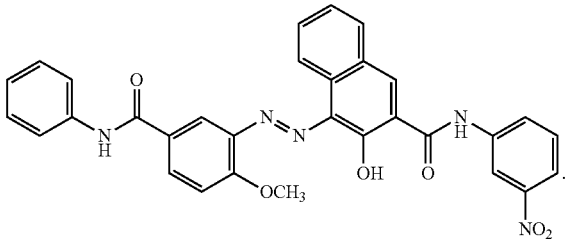

8. A magenta toner having a toner particle containing a binder resin, a wax and a colorant, wherein the colorant contains a pigment comprising a compound (1), a compound (2), and a compound (3) in solid solution a content of the compound (1) is 0.5 to 20.0 mass parts per 100 mass parts of the binder resin, and the binder resin contains a polyester resin, a content ratio of the polyester resin is 50 to 100 mass % of a total of the binder resin:

(1)

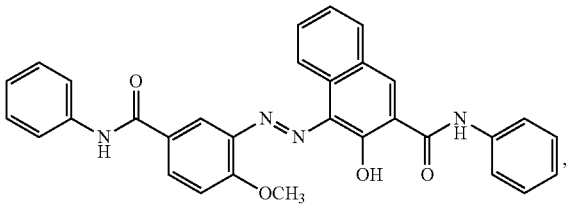

(2)

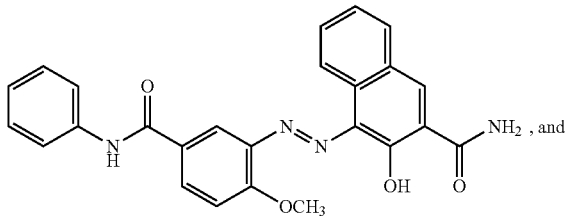

(3)

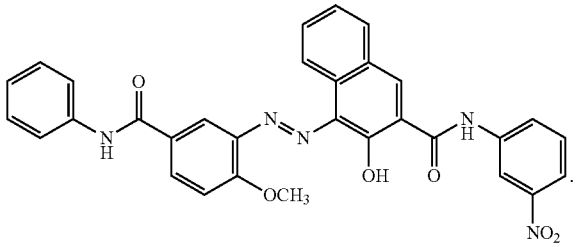

* * * * *